US009090092B2

(12) United States Patent
Bitoh et al.

(10) Patent No.: US 9,090,092 B2
(45) Date of Patent: Jul. 28, 2015

(54) NAIL PRINT APPARATUS AND PRINT CONTROL METHOD THEREOF

(71) Applicant: CASIO COMPUTER CO., LTD., Shibuya-ku, Tokyo (JP)

(72) Inventors: Hiroyasu Bitoh, Ome (JP); Nobuyuki Mochinaga, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/062,783

(22) Filed: Oct. 24, 2013

(65) Prior Publication Data

US 2014/0132968 A1 May 15, 2014

(30) Foreign Application Priority Data

Nov. 9, 2012 (JP) ..... 2012-247105

(51) Int. Cl.
*B41J 3/407* (2006.01)
*A45D 29/00* (2006.01)

(52) U.S. Cl.
CPC ..... *B41J 3/4073* (2013.01); *A45D 29/00* (2013.01); *B41J 3/407* (2013.01); *A45D 2029/005* (2013.01)

(58) Field of Classification Search
CPC ..... A45D 2029/005; A45D 29/004
See application file for complete search history.

(56) References Cited

U.S. PATENT DOCUMENTS 5,931,166 A * 8/1999 Weber et al. ..... 132/73
6,035,860 A * 3/2000 Mombourquette ..... 132/200
6,286,517 B1 9/2001 Weber et al.
6,525,724 B1 2/2003 Takami
2007/0092634 A1 4/2007 Zhang
2011/0304877 A1* 12/2011 Bitoh ..... 358/1.15
2012/0113171 A1* 5/2012 Murata ..... 347/2
2012/0147107 A1* 6/2012 Bitoh ..... 347/101
2012/0147113 A1* 6/2012 Yamasaki ..... 347/104

FOREIGN PATENT DOCUMENTS

CN 1569471 A 1/2005
JP 2000194838 A 7/2000
JP 2002165632 A 6/2002
JP 2003-534083 A 11/2003
JP 2012135587 A 7/2012

OTHER PUBLICATIONS

Japanese Office Action dated Feb. 17, 2015, issued in counterpart Japanese Application No. 2012-247105.
Chinese Office Action (and English translation thereof) dated Apr. 1, 2015, issued in counterpart Chinese Application No. 201310552712.X.

* cited by examiner

*Primary Examiner* — Fan Zhang
(74) *Attorney, Agent, or Firm* — Holtz, Holtz, Goodman & Chick PC

(57) ABSTRACT

A nail print apparatus, including: a finger inserting unit in which a finger including a nail to be printed is inserted; an accessory holding unit which is located in the finger inserting unit and on which at least one decorative part of an accessory is placed; and a print head which performs printing on the nail of the finger that is inserted into the finger inserting unit and a printing surface to be printed of the decorative part that is located in the finger inserting unit and placed on the accessory holding unit.

16 Claims, 29 Drawing Sheets

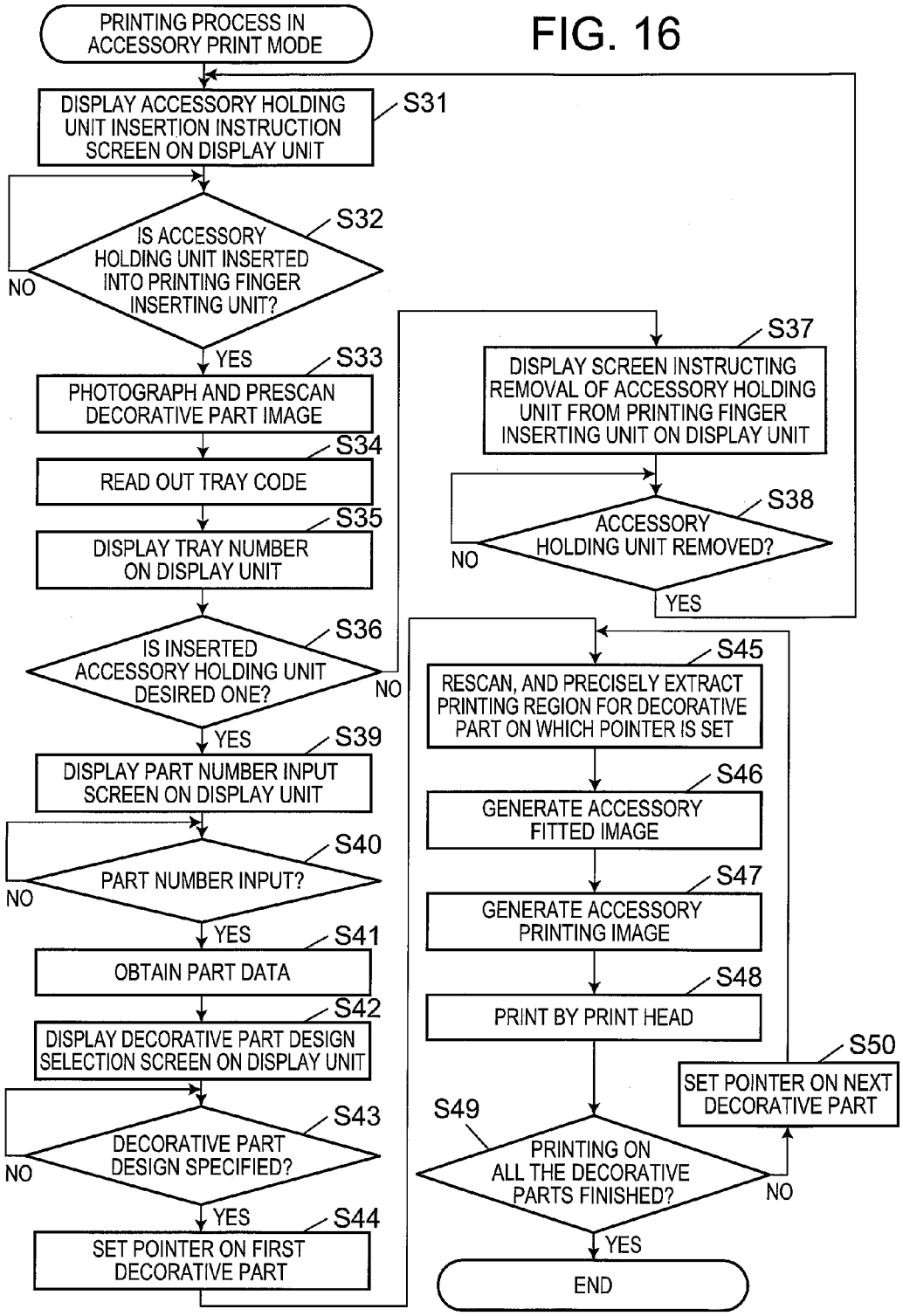
FIG. 16
PRINTING PROCESS IN ACCESSORY PRINT MODE
DISPLAY ACCESSORY HOLDING UNIT INSERTION INSTRUCTION SCREEN ON DISPLAY UNIT
S31
IS ACCESSORY HOLDING UNIT INSERTED INTO PRINTING FINGER INSERTING UNIT?
S32
NO
YES
PHOTOGRAPH AND PRESCAN DECORATIVE PART IMAGE
S33
READ OUT TRAY CODE
S34
DISPLAY TRAY NUMBER ON DISPLAY UNIT
S35
IS INSERTED ACCESSORY HOLDING UNIT DESIRED ONE?
S36
NO
YES
DISPLAY PART NUMBER INPUT SCREEN ON DISPLAY UNIT
S39
PART NUMBER INPUT?
S40
NO
YES
OBTAIN PART DATA
S41
DISPLAY DECORATIVE PART DESIGN SELECTION SCREEN ON DISPLAY UNIT
S42
DECORATIVE PART DESIGN SPECIFIED?
S43
NO
YES
SET POINTER ON FIRST DECORATIVE PART
S44
DISPLAY SCREEN INSTRUCTING REMOVAL OF ACCESSORY HOLDING UNIT FROM PRINTING FINGER INSERTING UNIT ON DISPLAY UNIT
S37
ACCESSORY HOLDING UNIT REMOVED?
S38
NO
YES
RESCAN, AND PRECISELY EXTRACT PRINTING REGION FOR DECORATIVE PART ON WHICH POINTER IS SET
S45
GENERATE ACCESSORY FITTED IMAGE
S46
GENERATE ACCESSORY PRINTING IMAGE
S47
PRINT BY PRINT HEAD
S48
PRINTING ON ALL THE DECORATIVE PARTS FINISHED?
S49
NO
YES
SET POINTER ON NEXT DECORATIVE PART
S50
END

NAIL PRINT APPARATUS AND PRINT CONTROL METHOD THEREOF

CROSS-REFERENCE TO RELATED APPLICATIONS

The entire disclosure of Japanese Patent Application No. 2012-247105 filed on Nov. 9, 2012 including description, claims, drawings, and abstract are incorporated herein by reference in its entirety.

BACKGROUND OF THE INVENTION

1. Field of the Invention

The present invention relates to a nail print apparatus and a print control method thereof.

2. Description of Related Art

Conventional nail print apparatuses to print desired design images on fingernails of people as a fashion are described in Japanese Unexamined Patent Application Publication No. 2003-534083, for example.

By using such apparatuses, nail printing can be enjoyed easily without visiting nail salons and such like.

It is also general that a user who prints a design image on nails as a fashion wears accessories such as earrings and a pendant as a decoration at the same time. In such case, in order to have unity of decoration among the nails and the accessories, it is preferable that the design image to be printed on the nails and the design to be decorated on the accessories have related patterns, color tones and atmosphere to have unity therebetween. Thus, in order to have unity between the design image to be printed on the nails and the design of the accessories, it is preferable that the nail print apparatus can print a design image which is identical with the design image to be printed on the nails and the design image (related design image) which is related to the design image to be printed on the nails in pattern, color tone and atmosphere.

However, conventional nail print apparatuses cannot perform printing on accessories other than nails since the nail print apparatuses are specialized in printing on nails and do not include jigs, mechanisms, software and such like for printing on accessories.

Thus, in order to have unity between the design image to be printed on nails and the design of accessories, the user needs to purchase accessories which suit the design image to be printed on the nails by himself/herself or can choose only the design image which suits the accessories which the user has. Thus, there have been inconvenience and limited choice of design image.

SUMMARY OF THE INVENTION

An object of the present invention is to provide a nail print apparatus and a print control method thereof by which a design image which is identical to a design image to be printed on nails and a design image which is related to the design image in pattern, color tone and atmosphere can be printed on accessories.

In order to solve the above object, according to one aspect of the present invention, there is provided a nail print apparatus, including: a finger inserting unit in which a finger including a nail to be printed is inserted; an accessory holding unit which is located in the finger inserting unit and on which at least one decorative part of an accessory is placed; and a print head which performs printing on the nail of the finger that is inserted into the finger inserting unit and a printing surface to be printed of the decorative part that is located in the finger inserting unit and placed on the accessory holding unit.

According to the other aspect of the present invention, there is provided a print control method of a nail print apparatus, wherein the nail print apparatus includes: a finger inserting unit in which a finger including a nail to be printed is inserted; and an accessory holding unit which is located in the finger inserting unit and on which at least one decorative part of an accessory is placed, the nail print apparatus performs printing on the nail of the finger with a print head when the finger is inserted into the finger inserting unit, and the nail print apparatus performs printing on a printing surface to be printed of the decorative part with the print head when the decorative part is placed on the accessory holding unit which is located in the finger inserting unit.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 16 is a flowchart showing printing process in an accessory print mode of the first embodiment;

FIG. 283 is a sectional view of the accessory holding unit of FIG. 28A along the line E-E;

DETAILED DESCRIPTION OF THE PREFERRED EMBODIMENT

Hereinafter, a nail print apparatus and a print control method thereof according to the present invention will be described in detail by showing embodiments.

First Embodiment

With reference to FIGS. 1 to 18D, a first embodiment of a nail print apparatus 1 according to the present invention will be described.

Figure 1:
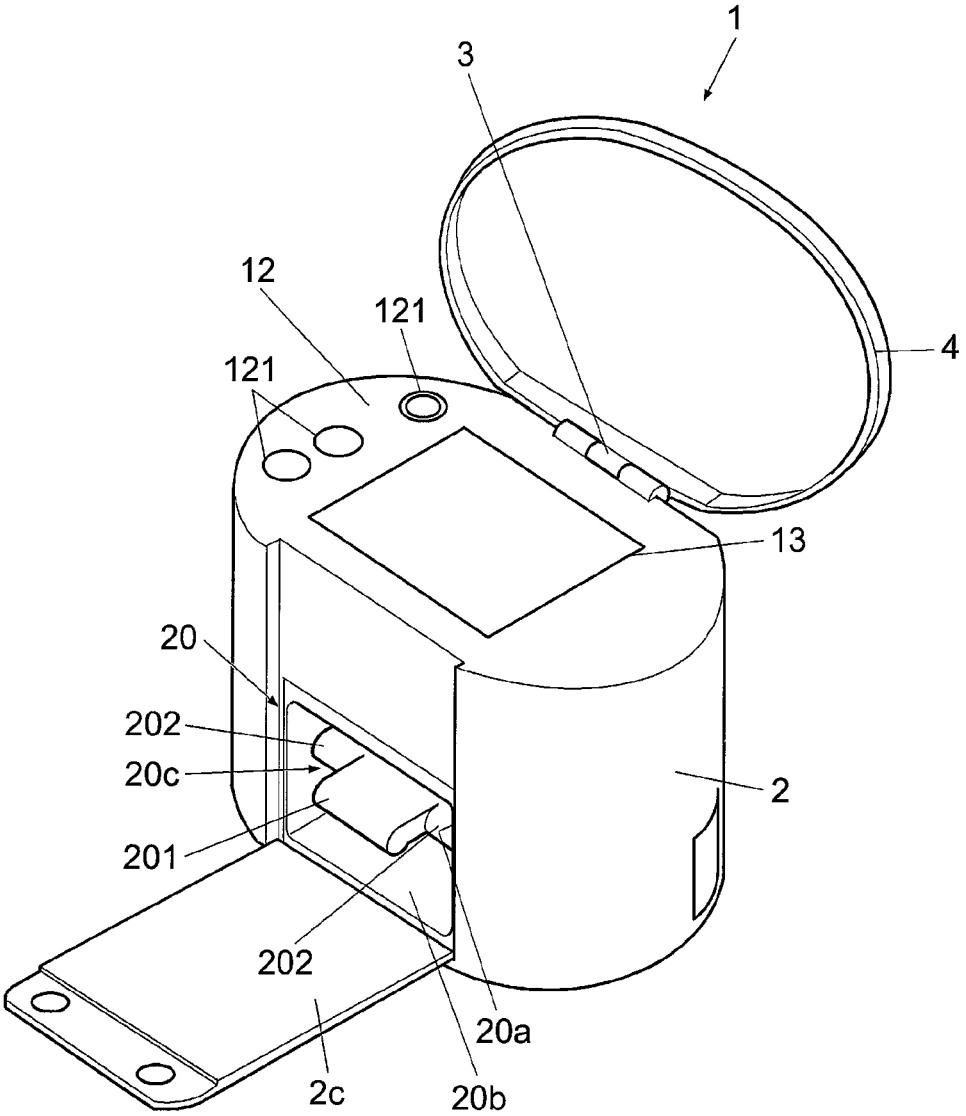
FIG. 1 is a schematic diagram conceptually showing an embodiment of a nail print apparatus of the present invention, which shows a state where a cover is open.

FIG. 1 is a schematic view showing the outer appearance of the nail print apparatus 1 in the embodiment.

Figure 2:
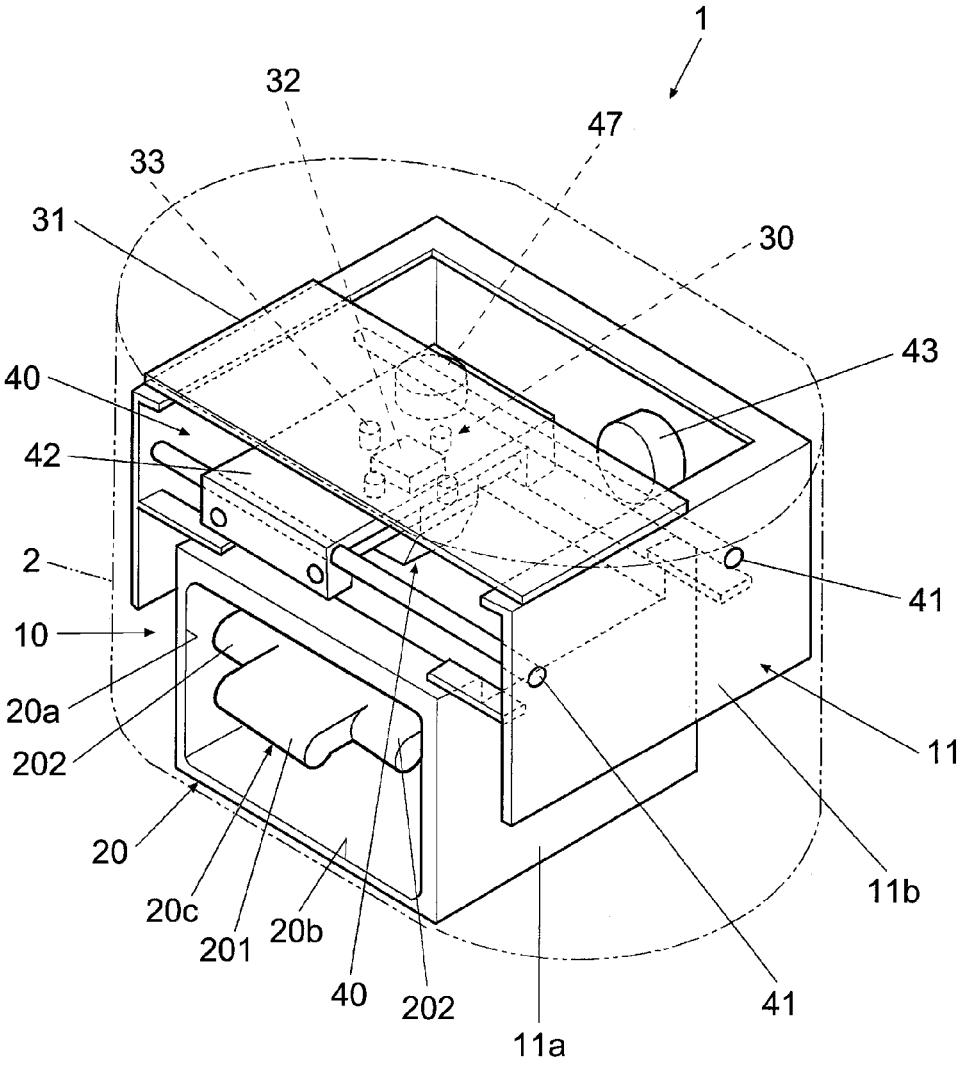
FIG. 2 is a schematic diagram conceptually showing an apparatus main body of the nail print apparatus of FIG. 1.

FIG. 2 is a schematic view showing an inner configuration of the nail print apparatus 1.

Figure 6B:
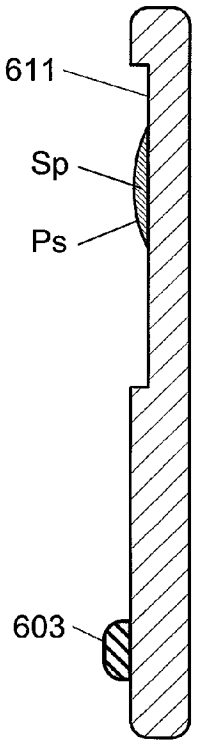
FIG. 6B is a sectional view of the accessory holding unit in FIG. 6A along the line A-A.
Figure 6A:
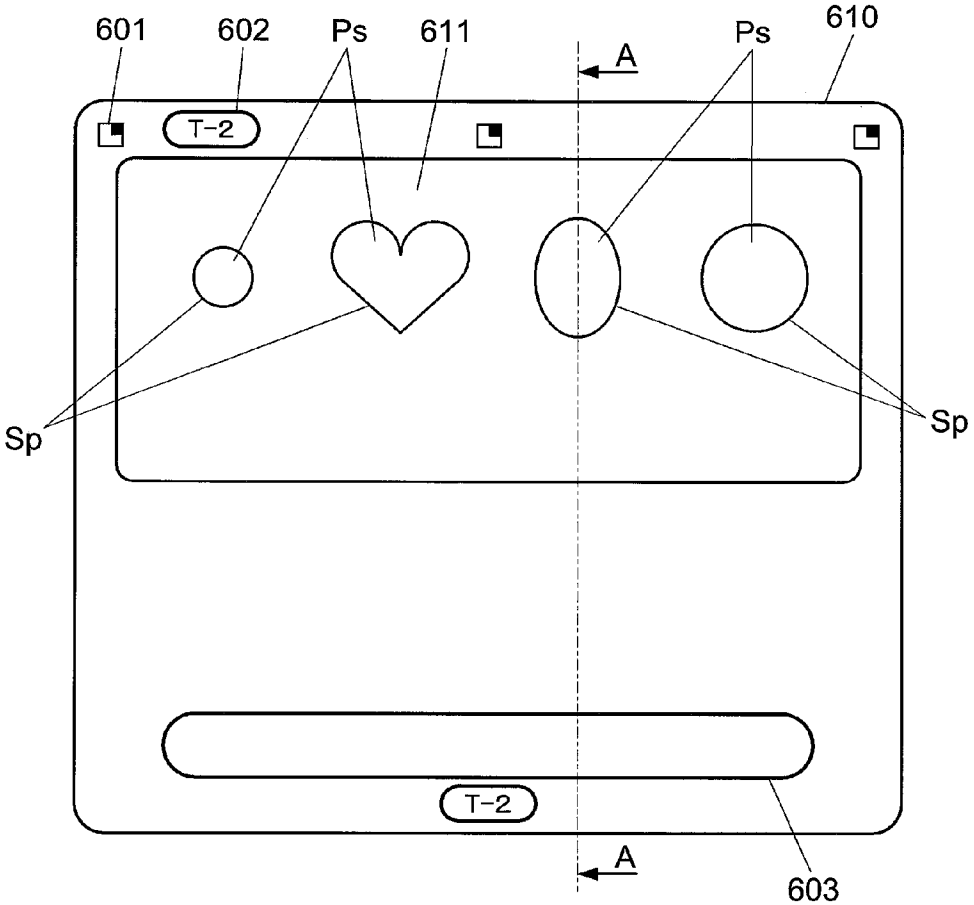
FIG. 6A is a plan view of an accessory holding unit in the first embodiment.

In the embodiment, besides printing various design images on fingernails, the nail print apparatus 1 can print a design image to be printed on nails T and a design image related to the design image in pattern, color tone and atmosphere on a printing surface (part printing surface Ps) of a printing target (decorative part Sp in the embodiment) of an accessory S placed on a printing target placement area 611 which is included in an accessory holding unit 610 (see FIGS. 6A and 6B, for example).

In the description below, a design image to be printed on a nail T is called "nail design Dn", a design image to be printed on a decorative part Sp (same design image as the nail design Dn) is called "decorative part design Ds" and a design image which is related to the nail design Dn that is a design image to be printed on the nail T in pattern, color tone and atmosphere is called "related design image R".

Figure 17A:
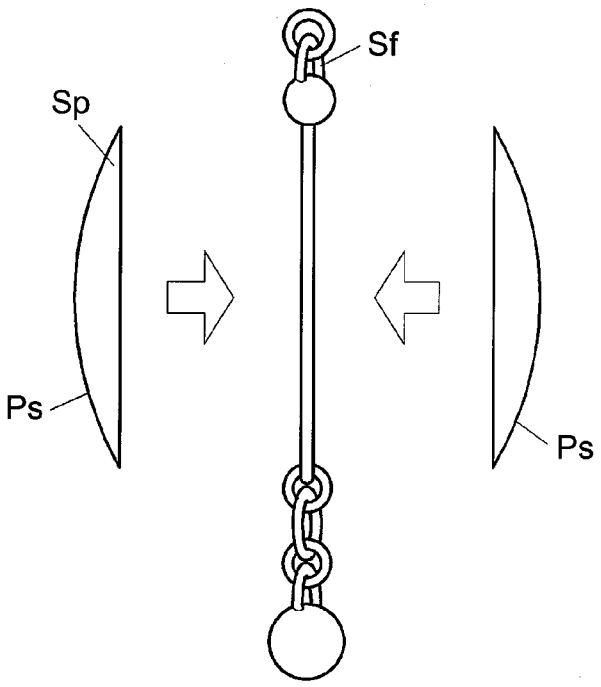
FIG. 17A is an explanation view showing an example of a state where decorative parts are removed from an accessory frame.

In the embodiment, as shown in FIG. 17A, for example, the accessory S is formed by setting the decorative parts Sp in the accessory frame Sf and the decorative parts Sp can be removed from the accessory S. In the embodiment, a part number for identifying decorative part Sp is assigned to each of the decorative parts Sp.

As shown in FIG. 1, the nail print apparatus 1 of the embodiment includes an apparatus main body 10 including a printing finger inserting unit 20*a* which is a finger inserting unit to insert a finger (printing finger U1) corresponding to a nail to be printed and the accessory holding unit 610 (see FIGS. 6A and 6B) which is provided so as to be inserted into and removed from the printing finger inserting unit 20*a* in addition to a case main body 2 and a cover 4, for example.

In the embodiment, the case main body 2 and the cover 4 are connected to each other via a hinge 3 provided at an upper rear end portion of the case main body 2.

The case main body 2 is formed in an oval shape in a plan view. An opening/closing plate 2*c* is provided at the front side of the case main body 2 so as to be able to flip up and down.

The opening/closing plate 2*c* is joined to the case main body 2 via a hinge (not shown in the drawings) which is provided at the lower end portion of the front surface of the case main body 2. The opening/closing plate 2*c* is for opening and closing the front surface of the case main body 2.

An after-mentioned operation unit 12 is set on the upper surface (top plate) of the case main body 2, and a display unit 13 is set at a nearly central portion of the upper surface (top plate).

The shapes and configurations of the case main body 2 and the cover 4 are not limited to the examples illustrated here.

An apparatus main body 10 of the nail print apparatus 1 is contained in the case main body 2. The apparatus main body 10 includes a printing finger fixing unit 20, a photographing unit 30 and a printing unit 40 which are shown in FIG. 2 and a control device 50 (see FIG. 10). The printing finger fixing unit 20, the photographing unit 30, the printing unit 40 and the control device 50 are provided in a machine casing 11.

As shown in FIG. 2, the machine casing 11 is configured by including a lower machine casing 11*a* and an upper machine casing 11*b*. The lower machine casing 11*a* is formed in a box shape and is set at lower side in the case main body 2. The upper machine casing 11*b* is set above the lower machine casing 11*a* and at the upper section inside the case main body 2.

The printing finger fixing unit 20 is provided in the lower machine casing 11*a* of the machine casing 11. The printing finger fixing unit 20 is configured by including a printing finger inserting unit 20*a, a* non-printing finger inserting unit 20*b* and a finger placement unit 20*c* which are provided in the lower machine casing 11*a*.

Here, the printing finger inserting unit 20*a* is a finger inserting unit for inserting fingers (hereinafter, called "printing fingers U1") corresponding to nails T to be printed (see FIG. 3).

The non-printing finger inserting unit 20*b* is a finger inserting unit for inserting a finger (hereinafter called "non-printing finger U2") other than the printing fingers U1 (see FIG. 3).

The finger placement unit 20*c* includes a placement surface in the side of the printing unit 40, and the printing fingers U1 are placed on the placement surface. Here, the placement surface is a flat surface.

In the embodiment, the finger placement unit 20*c* is a part which can be held between the printing fingers U1 inserted into the printing finger inserting unit 20*a* and the non-printing finger U2 inserted into the non-printing finger inserting unit 20*b* when the printing fingers U1 are placed on the placement surface.

In the embodiment, the finger placement unit 20*c* includes a dividing wall 21 which divides the printing finger inserting unit 20*a* from the non-printing finger inserting unit 20*b*.

A bulging portion 22 is formed at the end of the finger placement unit 20*c* from where fingers are inserted. The bulging portion 22 is formed at a part where bases U3 of the printing fingers U1 and the non-printing finger U2 abut when the printing fingers U1 and the non-printing finger U2 are deeply inserted in the printing finger inserting unit 20*a* and the non-printing finger inserting unit 20*b*, respectively.

The cross-section of the bulging portion 22 when cut along the finger insertion direction is circular so as to bulge downward from the lower surface of the finger placement unit 20*c* so that the finger placement unit 20*c* can be held firmly between the printing fingers U1 and the non-printing finger U2 in a state where the entire balls of the printing fingers U1 abut the finger placement unit 20*c*. The shape of the bulging portion 22 is not limited to the cross-sectional circle, and may be a cross-sectional oval and a non-circle such as a polygon.

Figure 3:
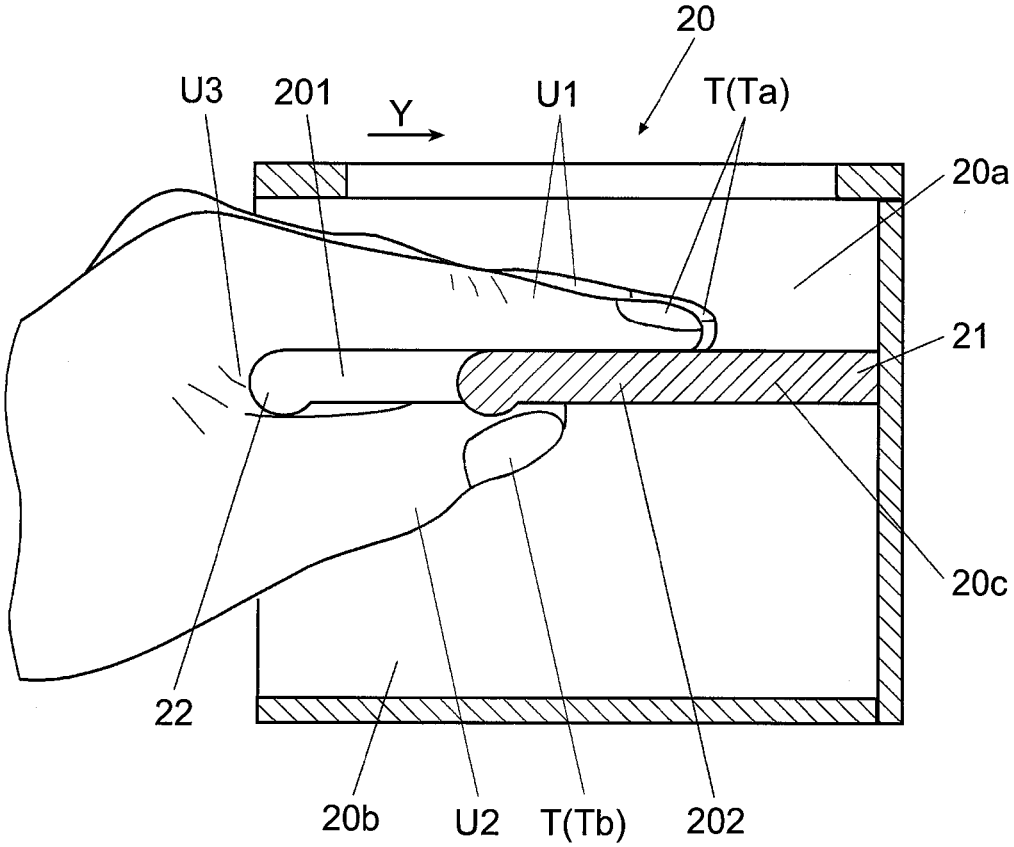
FIG. 3 is a sectional view showing a printing finger fixing unit which is a main part of the nail print apparatus of FIG. 1, showing a fixed state where an index finger to a little finger as printing fingers are inserted into a printing finger inserting unit.

FIG. 3 specifically shows an example of a fixed state of printing fingers U1 in a case where four fingers (index finger, middle finger, ring finger and little finger) other than the thumb of the left hand are printing fingers U1.

In such case, as shown in FIG. 3, the printing fingers U1 are fixed on the finger placement unit 20*c* by the user holding the finger placement 20*c* between the printing fingers U1 inserted into the printing finger inserting unit 20*a* and the non-printing finger U2 inserted into the non-printing finger inserting unit 20*b*.

As shown in FIGS. 1 and 3, for example, in the embodiment, a first finger positioning unit 201 is located at a central portion in the width direction of the finger placement unit 20*c*, the first finger positioning unit 201 enabling positioning of the four fingers of index finger to little finger by abutting the bases U3 of the four fingers from index finger to little finger which are the printing fingers U1 inserted into the printing finger inserting unit 20*a* and the other finger (that is, the thumb) which is the non-printing finger U2 inserted into the non-printing finger inserting unit 20*b* at the end portion thereof.

In the embodiment, the length of the first finger positioning unit 201 in the width direction X is nearly the same or a little larger than the lateral width of the four fingers from index finger to little finger inserted into the printing finger inserting unit 20*a*.

The first finger positioning unit 201 only needs to support the index finger to little finger inserted into the printing finger inserting unit 20*a* and the length in the width direction X may be smaller than the lateral width of the four fingers from index finger to little finger.

The left and right hands can be inserted into the printing finger fixing unit 20 at the same time, and when one of the hands is inserted to a position corresponding to the first finger positioning unit 201 of the printing finger inserting unit 20*a*, at the lateral sides of the first finger positioning unit 201, the finger placement unit 20*c* is provided with second finger positioning units 202 which can position the thumb of the other hand inserted into the printing finger inserting unit 20*a* by abutting, at the end portions, bases U3 of the thumb that is the printing finger U1 inserted into the printing finger inserting unit 20*a* and of the other fingers (that is, four fingers from index finger to little finger) that are the non-printing fingers U2 inserted into the non-printing finger inserting unit 20*b*.

Each of the second finger positioning units 202 is located at a position where the end portion thereof is shifted to be deeper in the insertion direction Y of printing finger than the end portion of the first finger positioning unit 201. The degree of the gap between the end portion of the second finger positioning unit 202 and the end portion of the first finger positioning unit 201 is not especially limited; however, preferable degree is such that the nail Tb of the thumb and the nails Ta of the other four fingers are nearly laterally aligned.

Alignment of the printing fingers of the thumb and the other four fingers in the insertion direction Y can narrow the photographable region of the photographing unit 30 and the printable region of the print head 46.

With respect to this, as for a person's hand, the thumb is shorter than the other four fingers and there is a difference of 40 to 75 mm in length between the thumb and the four fingers though the difference varies by the person and the way of holding. Thus, in consideration of the difference of the length of fingers, it is preferable that the end portions of the second finger positioning units 202 are located more deeply in the insertion direction Y of the printing finger U1 than the end portion of the first finger positioning unit 201 by approximately 40 to 75 mm.

Figure 4A:
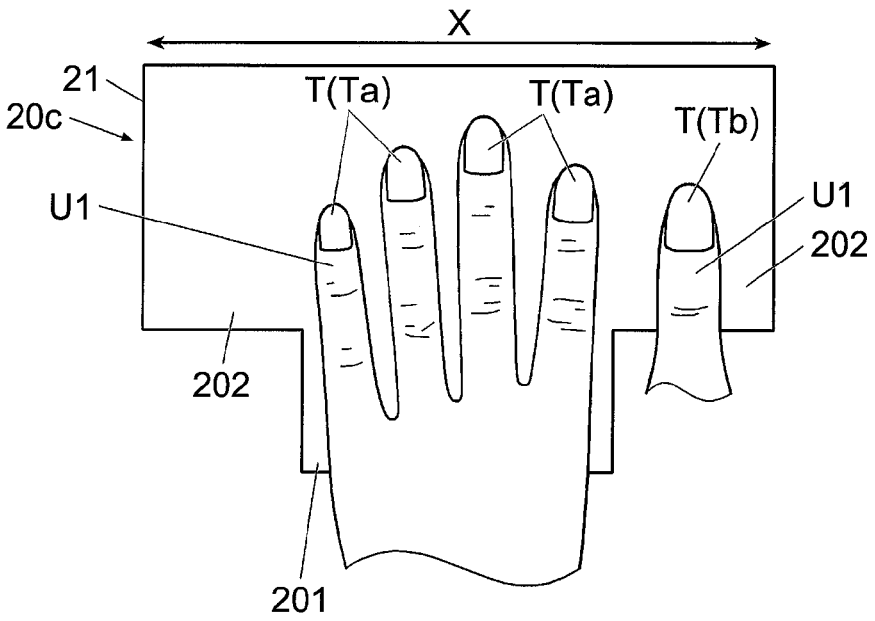
FIG. 4A is a plan view of a grasping unit of a first embodiment showing a state where the index finger to little finger of a left hand are positioned by a first finger positioning unit and the thumb of the right hand is positioned by a second finger positioning unit.

FIG. 4A shows a state where four fingers (index finger, middle finger, ring finger and little finger) of the left hand are positioned on the first finger positioning unit 201 of the finger placement unit 20*c* and the thumb of the right hand is positioned on the second finger positioning unit 202 located on the right side of the first finger positioning unit 201.

Figure 4B:
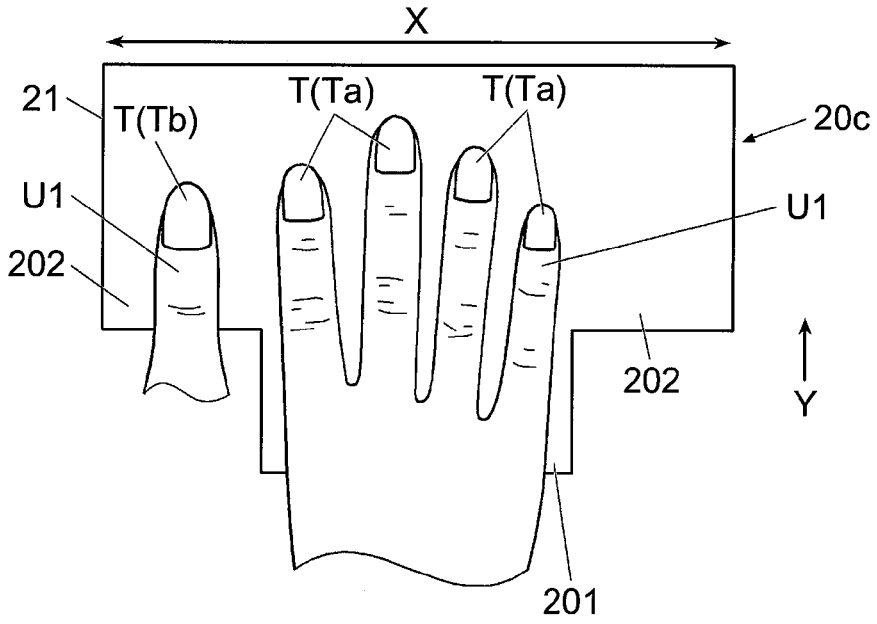
FIG. 4B is a diagram showing a state where the index finger to little finger of the right hand are positioned by the first finger positioning unit and the thumb of the left hand is positioned by the second finger positioning unit.

FIG. 4B shows a state where four fingers (index finger, middle finger, ring finger and little finger) of the right hand are positioned on the first finger positioning unit 201 of the finger placement unit 20*c* and the thumb of the left hand is positioned on the second finger positioning unit 202 located on the left side of the first finger positioning unit 201.

Figure 5:
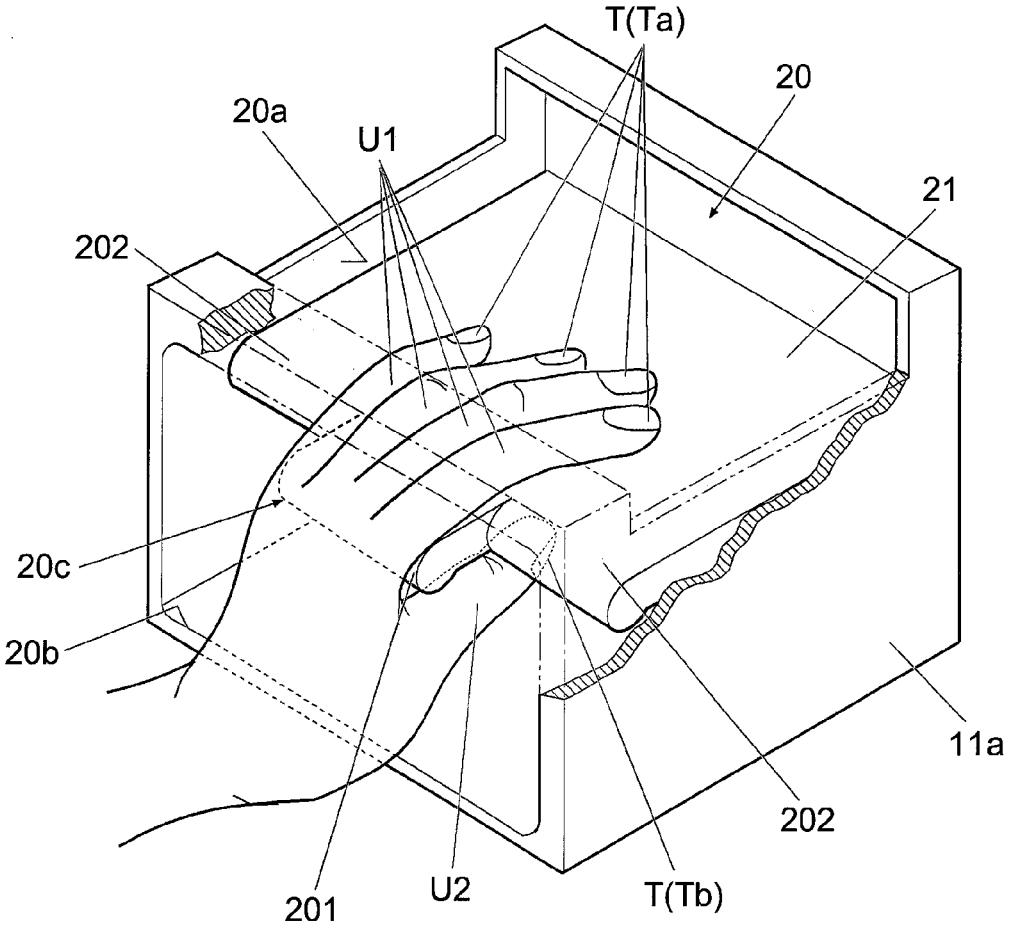
FIG. 5 is a schematic diagram showing the printing finger fixing unit in a case where only the four fingers are placed on a finger placement unit to be printed.

FIG. 5 is a schematic view of the printing finger fixing unit 20 showing an example of a case where only the four fingers are placed on the finger placement unit 20*c* to be printed.

Figure 17B:
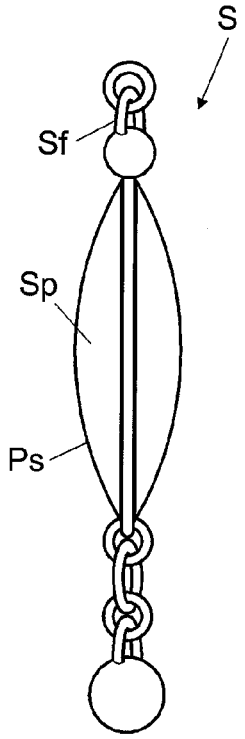
FIG. 17B is an explanation view showing an example of the accessory in which the decorative parts are attached to the accessory frame of FIG. 17A.

In the embodiment, as described above, a design image (decorative part design Ds and such like) can be printed on a decorative part Sp by inserting, into the printing finger inserting unit 20*a*, the accessory holding unit 610 (see FIGS. 6A and 6B, for example) on which the decorative part Sp that is a printing target removed from the accessory S as shown in FIG. 17B is placed and placing the accessory holding unit 610 on the placement surface of the finger placement unit 20*c*.

The decorative part Sp in the embodiment is formed of transparent resin, for example, and the part printing surface Ps is colored (surface treatment) by ink or such like so that an after-mentioned print region extracting unit 523 can precisely extract the region (part printing region Ak, see FIG. 13) of the part printing surface Ps from an after-mentioned decorative part image.

Though the color for coloring decorative part Sp is not especially limited, white color is preferable so as not to influence the color tone of the printed design image.

In this case, preferable color of the printing target placement area 611 is such color that the print region extracting unit 523 can easily extract the part printing region Ak (for example, black in a case where the surface of the decorative part Sp is processed to be white).

Here, the accessory holding unit 610 in the embodiment will be described with reference to FIGS. 6A and 6B.

FIG. 6A is a plan view of the accessory holding unit 610 in the first embodiment.

FIG. 6B is a sectional view of the accessory holding unit 610 in FIG. 6A along the line A-A.

Figure 7:
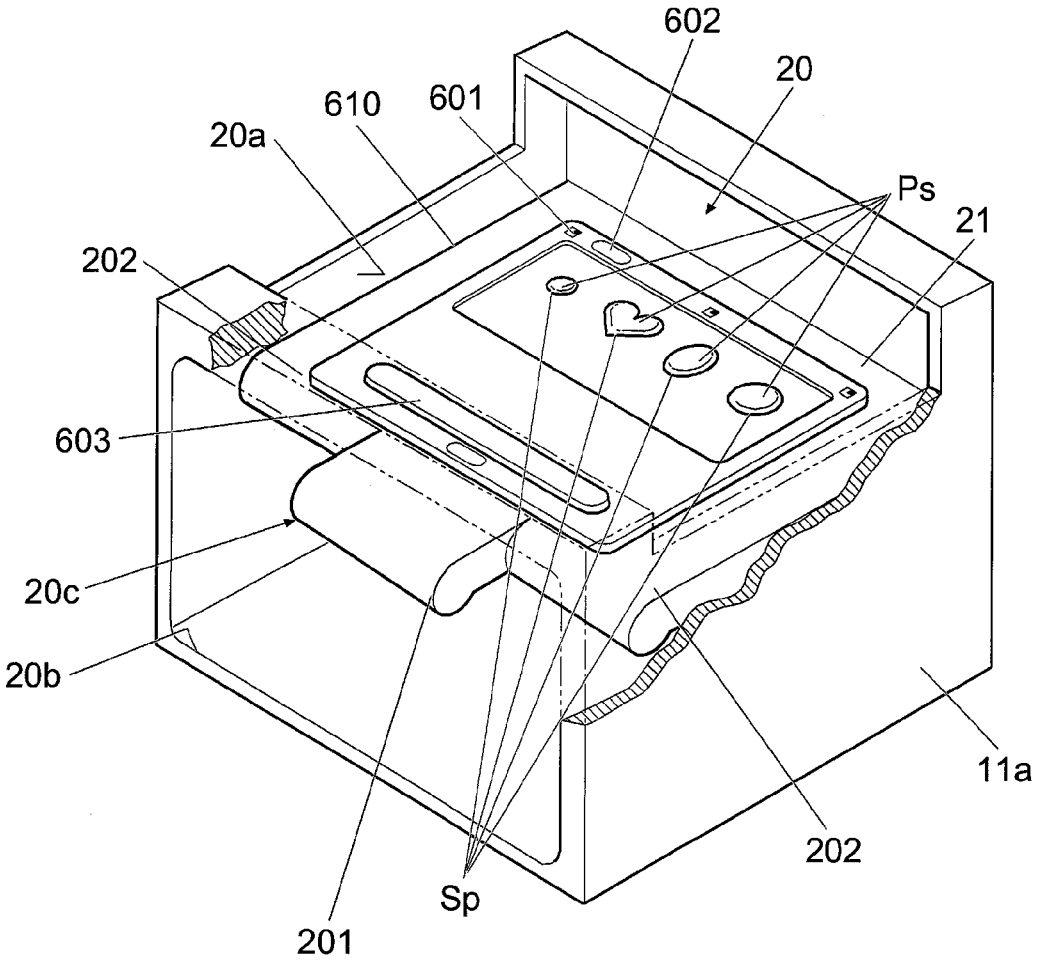
FIG. 7 is a schematic view showing a printing finger fixing unit in a case where the accessory holding unit shown in FIG. 6A is inserted on the finger placement unit and only accessories are printed.

FIG. 7 is a schematic view of the printing finger fixing unit 20 showing an example of a case where the accessory holding unit 610 shown in FIG. 6A is inserted onto the finger placement unit and only the accessory is printed.

Hereinafter, when the accessory holding unit 610 in which the decorative part Sp is placed on the printing target placement area 611 is inserted into the printing finger inserting unit 20*a*, the back side in the insertion direction Y is called "back side" and the front side in the insertion direction Y (that is, the insertion port side) is called "front side".

The accessory holding unit 610 is located inside the printing finger inserting unit 20*a* and at least the decorative part Sp (printing target) of the accessory S is placed thereon. When inserted into the printing finger inserting unit 20*a*, the accessory holding unit 610 in the embodiment is placed on the finger placement unit 20*c* as shown in FIG. 7.

Then, the accessory holding unit 610 is not fixed on the finger placement unit 20*c* and can be detached from the finger placement unit 20*c* so that the accessory holding unit 610 can be inserted into and removed from the printing finger inserting unit 20*a*.

In the embodiment, the accessory holding unit 610 is a plate-like member molded by resin, for example. The material forming the accessory holding unit 610 is not limited to resin.

The accessory holding unit 610 includes a printing target placement area 611 which is formed of a concave portion with such depth that, when the decorative part Sp is placed thereon, the part printing surface Ps of the decorative part Sp and the nails T of the printing fingers U1 placed on the finger placement unit 20*c* have nearly the same height.

In the embodiment, the decorative part Sp (printing target) of the accessory S is placed on the printing target placement area 611 which is included in the accessory holding unit 610. In addition, the accessory holding unit 610 also includes a tray code 601 and a tray number 602.

As shown in FIG. 6A, for example, the printing target placement area 611 is a concave portion of nearly rectangle in a plan view, which is formed in the back side on the upper surface of the accessory holding unit 610. The printing surface (part printing surface Ps) of the decorative part Sp removed from the accessory S is placed on the printing target placement area 611 so as to face the print head 46. In the embodiment, as shown in FIG. 6B, the surface of the decorative part Sp (the surface when attached to the accessory S) is the part printing surface Ps.

On the printing target placement area 611 in the embodiment, a plurality of decorative parts Sp are placed as shown in FIG. 6A.

The type and number of the accessory holding unit 610 are not especially limited.

In the embodiment, a plurality of types thereof which have different printing target placement areas 611 in shape and height are prepared so as to correspond to a plurality of shapes of the part printing surface Ps.

The tray code 601 is a code readable by an after-mentioned tray code reading unit 526.

In the embodiment, the tray code 601 includes information (after-mentioned tray number 602, for example) for identifying the type of the accessory holding unit 610 and the other information regarding the accessory holding unit 610.

By the tray code reading unit 526 reading the tray code 601, the type of the accessory holding unit 610 inserted into the printing finger inserting unit 20*a* is identified. The information (tray information) included in the tray code 601 is not especially limited to the example described here.

In the embodiment, two-dimensional code is used as the tray code 601.

The "two-dimensional code" is the tray code 601 storing information by code which has a meaning in both the vertical and horizontal directions. The tray code 601 is not especially limited as long as it is readable by the photographing unit 30, and may be a one-dimensional code storing information by a code which has a meaning only in the one direction of vertical or horizontal direction such as barcode. However, the two-dimensional code as used in the embodiment is preferable since more information can be included in the tray code 601.

The position of the tray code 601 is not limited to the illustrated example as long as the photographing unit 30 can photograph the tray code 601.

The tray number 602 is an identification number indicating the type of the accessory holding unit 610. The user can identify the type of the accessory holding unit 610 by visually confirming the tray number 602.

The position of the tray number 602 is not especially limited and may be both on the back and front sides of the accessory holding unit 610 as in the illustrated example and may be on one of them. Also, the tray number 602 may not be provided in a case where the user can easily identify the type of the accessory holding unit 610 according to the shape or such like of the accessory holding unit 610.

A non-slip unit 603 is formed on the upper surface of the accessory holding unit 610. The non-slip unit 603 is, for example, rubber attached so as to protrude from the upper surface of the accessory holding unit 610 so that fingers of the user are easy to catch and difficult to slip when inserting and removing the accessory holding unit 610 into and from the printing finger inserting unit 20*a*.

Figure 8A:
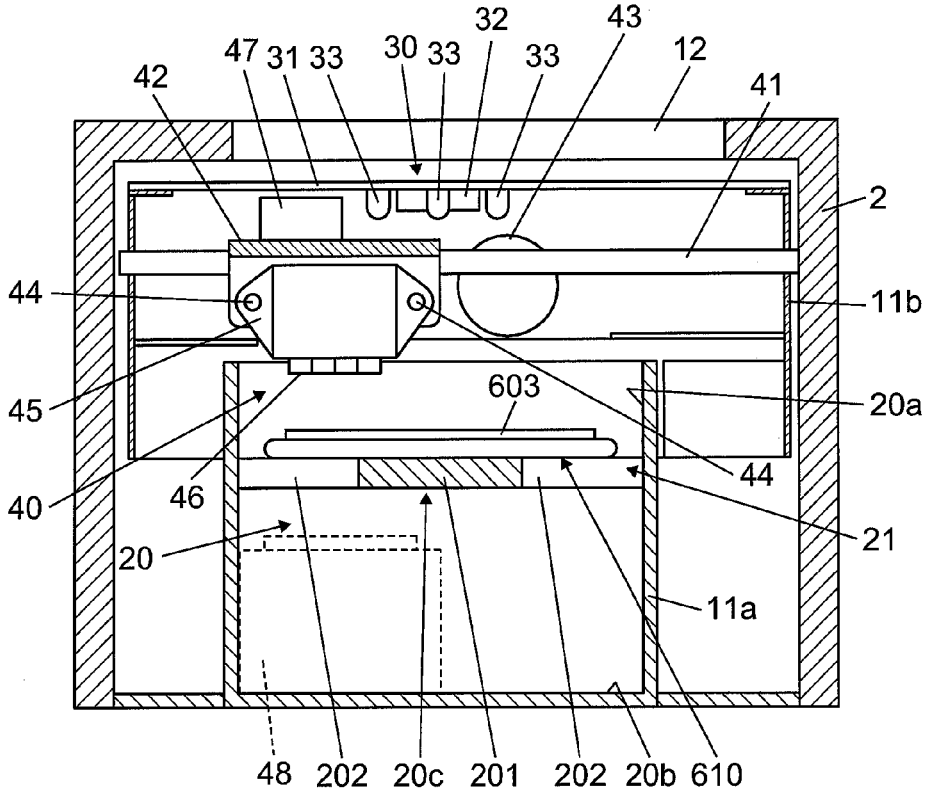
FIG. 8A is a front sectional view of the nail print apparatus of FIG. 1.

FIG. 8A is a front side sectional view of the nail print apparatus 1 in the embodiment.

Figure 9:
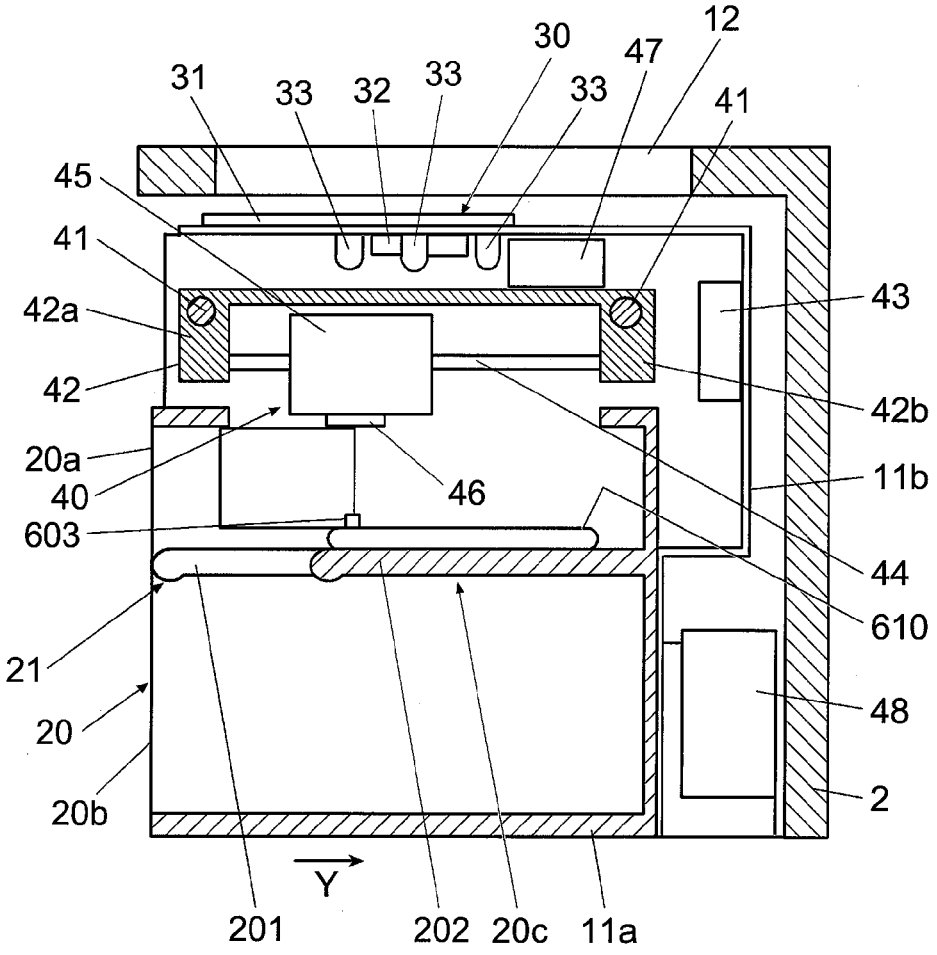
FIG. 9 is a side sectional view of the nail print apparatus of FIG. 1.

FIG. 9 is a side sectional view of the nail print apparatus 1.

As shown in FIGS. 8A and 9, the photographing unit 30 is provided on the upper machine casing 11*b* of the machine casing 11.

At the central portion of the lower surface of a substrate 31 which is set on the upper machine casing 11*b*, *a* camera 32 of approximately two million pixels or more which includes a built-in driver is set.

On the substrate 31, lights 33 such as white LEDs are set so as to surround the camera 32. The photographing unit 30 is configured by including the camera 32 and the lights 33.

The photographing unit 30 is connected to a photographing control unit 522 of an after-mentioned control device 50 and is controlled by the photographing control unit 522.

In the embodiment, the photographing unit 30 photographs, by the control of the photographing control unit 522, fingers (printing fingers U1) inserted into the printing finger inserting unit 20*a* and obtains a finger image including a nail region At (see FIG. 11) corresponding to the nail T of the printing finger U1.

Also, the photographing unit 30 photographs, by the control of the photographing control unit 522, the accessory holding unit 610 inserted into the printing finger inserting unit 20*a* and obtains an image of the accessory holding unit 610 (decorative part image) including the decorative part Sp placed on the printing target placement area 611, the tray code 601 and such like.

The image obtained by the photographing unit 30 may be appropriately stored in the storage unit 51 (see FIG. 10) and such like.

The configuration shown in FIG. 8A is a configuration in which the accessory holding unit 610 is directly placed on the finger placement unit 20*c*. However, the configuration may further include a mechanism for facilitating insertion of the accessory holding unit 610 into the printing finger inserting unit 20*c*.

Figure 8B:
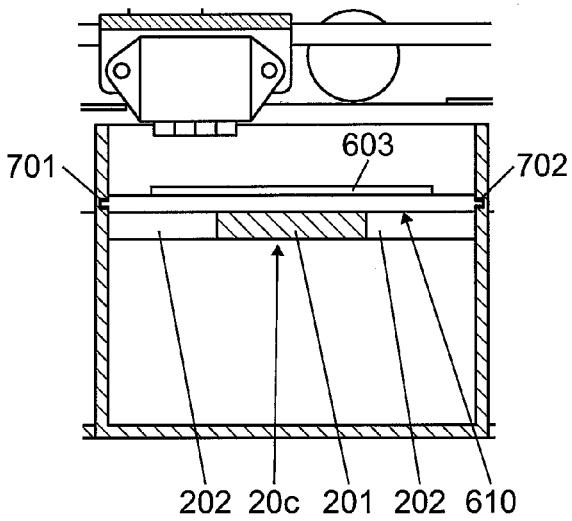
FIG. 8B is a diagram showing a main part of a first example of a mechanism for inserting the accessory holding unit into the printing finger inserting unit.
Figure 8C:
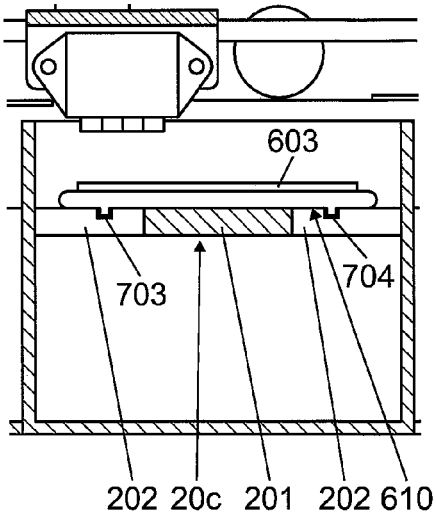
FIG. 8C is a diagram showing a main part of a second example of the mechanism for inserting the accessory holding unit into the printing finger inserting unit.

FIG. 8B is a diagram showing a main part of a first example of the mechanism for inserting the accessory holding unit into the printing finger inserting unit and FIG. 8C is a diagram showing a main part of a second example of a mechanism for inserting the accessory holding unit into the printing finger inserting unit.

As shown in FIG. 8B, in the first example of the mechanism, in a case where the size of the accessory holding unit 610 in the width direction is in such degree that the both lateral ends of the accessory holding unit 610 contact the side walls of the printing finger inserting unit 20*a*, grooves 701 and 702 which extend from the front side to the back side are formed on the side walls of the printing finger inserting unit 20*a* above the finger placement unit 20*c* and convex portions to be fitted in the grooves 701 and 702 are formed on the side surfaces of the accessory holding unit 610. Thus, the accessory holding unit 610 slides along the grooves and can be inserted into the printing finger inserting unit 20*a*. By such configuration, the user can insert and remove the accessory holding unit 610 into and from the printing finger inserting unit 20*a* easily.

The position of the convex portions formed on the accessory holding unit 610 is not especially limited as long as the accessory holding unit 610 can be fixed in a state where printing can be performed on decorative parts Sp and such like placed on the accessory holding unit 610. The convex portions may be formed on the side walls of the printing finger inserting unit 20*a* and the concave portions to fit in the convex portions may be formed on the side surfaces of the accessory holding unit 610.

As shown in FIG. 8C, in the second example of the mechanism, grooves 703 and 704 extending from the front side to the back side are formed on the upper surface of the finger placement unit 20*c*, and the convex portions to be fitted in the grooves are formed on the bottom surface of the accessory holding unit 610. Thus, the accessory holding unit 610 slides along the grooves 703 and 704 and can be inserted into the printing finger inserting unit 20*a*.

By such configuration, the user can also easily insert and remove the accessory holding unit 610 into and from the printing finger inserting unit 20*a*.

The printing unit 40 is mainly provided in the upper machine casing 11*b*.

That is, as shown in FIGS. 2 and 8A, two guide rods 41 are bridged in parallel to each other between the both side boards of the upper machine casing 11*b*. A main carriage 42 is slidably set at the guide rods 41.

As shown in FIG. 9, two guide rods 44 are bridged in parallel to each other between a front wall 42*a* and a rear wall 42*b* of the main carriage 42. A secondary carriage 45 is slidably set at the guide rods 44. The print head 46 is mounted on the central portion of the lower surface of the secondary carriage 45.

By the control of the after-mentioned printing control unit 525, the print head 46 performs printing on the decorative part Sp which is placed on the accessory holding unit 610 as well as printing on the nails T of the printing fingers U1 (the nails Ta of the four fingers of one hand and the nail Tb of the thumb of the other hand).

Though not especially limited, the print head 46 is an ink-jet type print head which makes ink be in the form of micro droplets and directly sprays the ink droplets onto a target to be printed to perform printing, for example.

The print head 46 can print ink including color materials corresponding to yellow, magenta, cyan and black, for example. The type and number of the ink printed by the print head 46 is not limited to the example described here.

The main carriage 42 is joined to a motor 43 via a power transmission unit and is configured to move to the left and right along the guide rods 41 by the forward-reverse rotation of the motor 43.

The secondary carriage 45 is joined to a motor 47 via a power transmission unit and is configured to move back and forth along the guide rods 44 by the forward-reverse rotation of the motor 47.

In the embodiment, the range of movement of the print head 46 is the printable range of the nail print apparatus 1, and printing on the printing fingers U1 and the decorative part Sp is performed within the printable range.

An ink cartridge 48 for supplying ink to the print head 46 is provided in the lower machine casing 11*a*.

The ink cartridge 48 is provided corresponding to each of the above inks and is connected to each of the print heads 46 via an ink supply tube to appropriately supply ink to the print head 46. Here, the configuration may be such that the ink cartridge is mounted on the print head 46 itself.

The printing unit 40 is configured by including the guide rods 41, the main carriage 42, the motor 43, the guide rods 44, the secondary carriage 45, the print head 46, the motor 47, the ink cartridge 48 and others.

The motor 43, the print head 46 and the motor 47 of the printing unit 40 are connected to the printing control unit 525 of the after-mentioned control device 50 and controlled by the printing control unit 525.

The operation unit 12 is an input unit for a user to perform various types of input.

In the embodiment, the operation unit 12 is provided with operation buttons 121 for turning on and off the nail print apparatus 1, inputting design selection instruction and performing other various types of input, for example.

The display unit 13 is configured by including a liquid crystal display (LCD: Liquid Crystal Display), an organic electroluminescent display and other flat display, for example.

In the embodiment, on the display unit 13, a mode selection screen (not shown in the drawings) for selecting whether to perform a nail print mode of printing a nail design Dn on nails T and an accessory print mode of printing a decorative part design Ds on a decorative part Sp is displayed.

By a user selecting whether to perform the nail print mode and the accessory print mode with the operation buttons 121, an instruction signal (mode selection instruction signal) for selecting whether to perform the nail print mode and the accessory print mode is output to the after-mentioned control unit 52 from the operation unit 12.

Furthermore, the display unit 13 displays a part number input screen for inputting a part number by the user operating the operation unit 12 and the like, a finger image obtained by photographing the printing finger U1 and an image of the nail region At showing a nail T in the finger image, a nail fitted image Gg (see FIG. 11) which is generated by fitting a design image (nail design Dn) to be printed on the nail T of the printing finger U1 to the nail region At, an accessory fitted image Kk (see FIG. 13) which is generated by fitting a design image (decorative part design Ds) to be printed on the part printing surface Ps into the part printing region Ak, thumbnail images for confirming designs and such like, a screen (nail design selection screen) for selecting the nail design Dn, a screen (decorative part design selection screen) for selecting the decorative part design Ds, a confirmation instruction screen for confirming whether the desired accessory holding unit 610 is inserted into the printing finger inserting unit 20*a* and the other various types of instruction screens, for example.

A touch panel may be integrally formed on the surface of the display unit 13. In such case, it is configured so that various types of input can be carried out also by touching the surface of the display unit 13 by touching operation with a stylus pen which is a writing tool of sharpened stick and write down by being pressed against the touch panel surface, a fingertip and the like (not shown in the drawings), for example.

In a case where whether to perform printing in the nail print mode or the accessory print mode can be selected with the touch panel, the touch panel of the display unit 13 also functions as the print mode selection unit.

Figure 10:
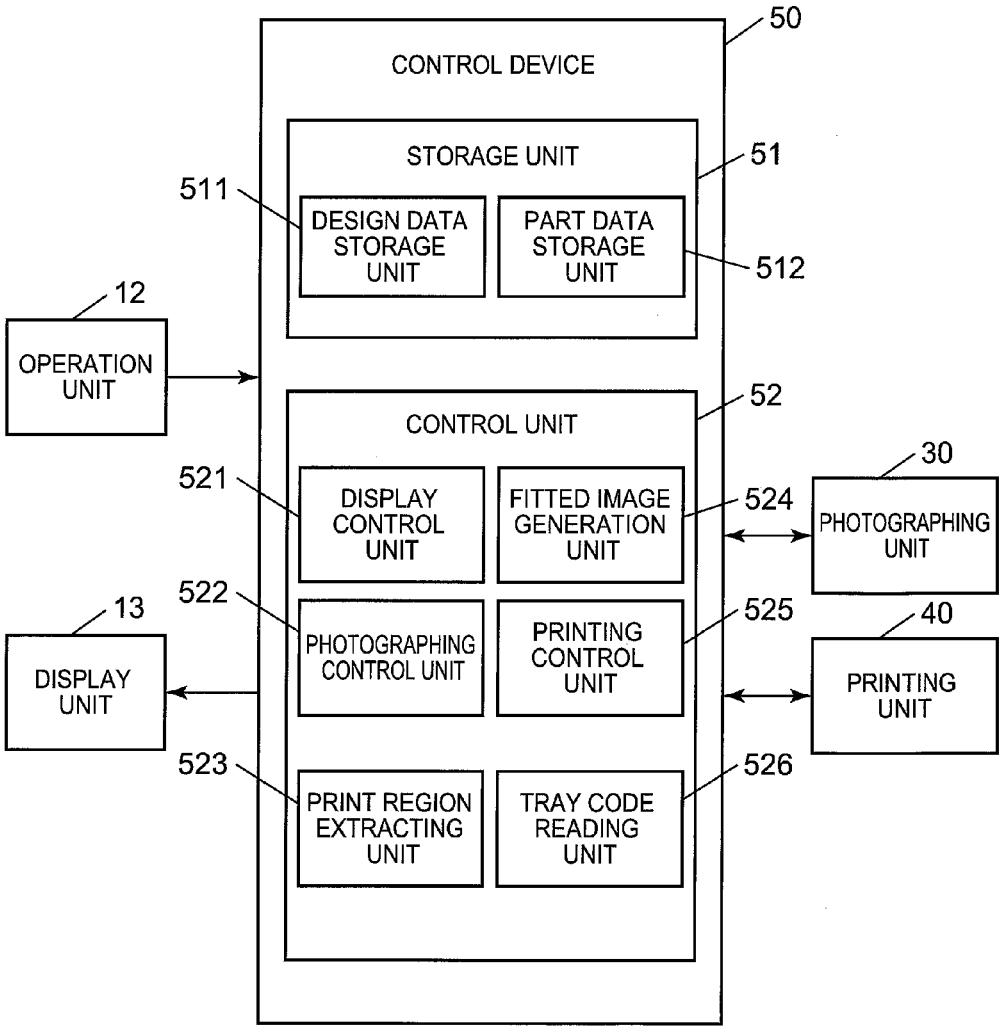
FIG. 10 is a main part block view showing a control structure of the nail print apparatus in the first embodiment.

The control device 50 is set on the substrate 31 disposed on the upper machine casing 11*b* and the like, for example. FIG. 10 is a main part block diagram showing a control structure in the embodiment.

The control device 50 is a computer which includes a storage unit 51 having a ROM (Read only memory), a RAM (Random access memory) and such like which are not shown in the drawings and a control unit 52 having a CPU (Central Processing Unit) and such like which are not shown in the drawings. The storage unit 51 is not limited to the ROM and RAM in the control device 50 and may be provided at other locations.

Various programs for operating the nail print apparatus 1, various data and such like are stored in the storage unit 51. In the embodiment, a design data storage unit 511 and a part data storage unit 512 are provided in the storage unit 51.

Data of the original image G of the design image is stored in the design data storage unit 511. In the design data storage unit 511, data of the original image G of the related design image R which is related to the design image in pattern, color tone and atmosphere is stored so as to be associated with the data of the original image G of the design image.

The number and such like of the data of the original image G of the design image stored in the design data storage unit 511 is not especially limited.

The data of the original image G of the design image is not limited to the data stored in the design data storage unit 511, and the configuration may be such that the data of the original image G of the design image can be taken from an outer storage unit such as a memory card, USB memory and various hard disk into the nail print apparatus 1 so as to be printed.

The part data such as a curvature, shape and size of the part printing surface Ps of each of the decorative parts Sp is stored in the part data storage unit 512 so as to be associated with the part number identifying the decorative part Sp. The part data stored in the part data storage unit 512 is readable on the basis of the corresponding part number.

For example, in a case of the decorative part Sp shown in FIG. 6B, the part printing surface Ps is in a circle in a plan view (see FIG. 6A) and curved so as to have increasing distance from the print head 46 from the central portion toward the end portions. Thus, in the part data storage unit 512, as the part data regarding the decorative part Sp shown in FIG. 6B, such shape in a plan view, the size, the degree of curve (curvature) of the surface and such like of the part printing surface Ps are stored so as to be associated with the part number of the part printing surface Ps.

The information included in the part data is not especially limited, and color information of the part printing surface Ps may be included, for example.

The control unit 52 includes, in a view of functionality, a display control unit 521, a photographing control unit 522, a print region extracting unit 523, a fitted image generation unit 524, a printing control unit 525, a tray code reading unit 526 and such like. The functions as the display control unit 521, the photographing control unit 522, the print region extracting unit 523, the fitted image generation unit 524, the printing control unit 525, the tray code reading unit 526 and such like are executed in cooperation between the CPU of the control unit 52 and programs stored in the ROM and such like of the storage unit 51.

In the embodiment, the control unit 52 obtains part data such as shape, size and curvature of the surface to be printed (part printing surface Ps) of the accessory S (in the embodiment, the decorative part Sp of the accessory S) from the part data Storage unit 512 on the basis of the part number input by the user.

The control unit 52 obtains data of the original image G of the design image of the nail design Dn (see FIG. 18A, for example) specified by the user.

Furthermore, the control unit 52 obtains the data of original image G of the related design image R (see FIGS. 18C and 18D) corresponding to the nail design Dn specified by the user from the design data storage unit 511.

In the embodiment, the control unit 52 determines whether the printing fingers U1 and the accessory holding unit 610 are inserted into the printing finger inserting unit 20*a* by analyzing the image obtained by the photographing unit 30.

The display control unit 521 makes the display unit 13 display various types of display screens.

In the embodiment, the display control unit 521 makes the display unit 13 display a finger image obtained by photographing the printing finger U1 and an image of the nail region At showing the nail T in the finger image, a decorative part image obtained by photographing the decorative part Sp and an image of the part printing region Ak, and in addition, displays various instruction screens such as the mode selection screen, the part number input screen for inputting the part number, a selection screen of the design image to be printed on the nails and the accessory and a hand insertion instruction screen, and a screen (accessory holding unit insertion instruction screen) for instructing insertion of the accessory holding unit 610, for example.

The photographing control unit 522 controls the photographing operation of the photographing unit 30 so as to photograph the finger image and such like of the printing finger U1 of the user inserted into the printing finger inserting unit 20*a*.

The photographing control unit 522 controls the photographing operation of the photographing unit 30 so as to photograph the accessory holding unit 610 inserted into the printing finger inserting unit 20*a* to photograph an image of the accessory holding unit 610 (decorative part image) including the decorative parts Sp placed on the printing target placement area 611, the tray code 601 and such like.

The photographing control unit 522 outputs the image data of the image obtained by the photographing unit 30 to the print region extracting unit 523 and such like in the embodiment; however, the invention is not limited to this. The image data may be stored in the storage unit 51, for example.

The print region extracting unit 523 extracts the nail region At (see FIG. 11) corresponding to the nail T included in the finger image of the printing finger U1 obtained by the photographing unit 30 from the finger image.

The print region extracting unit 523 extracts, in the finger image input from the photographing control unit 522, the nail region At (the outline of the nail T) on the basis of the difference in color between the nail T and the other portion of the finger, for example. The method of extracting the nail region At by the print region extracting unit 523 is not especially limited nor limited to the example described here.

The print region extracting unit 523 obtains the accessory printing region corresponding to the part printing surface Ps of the decorative part Sp.

Figure 13:
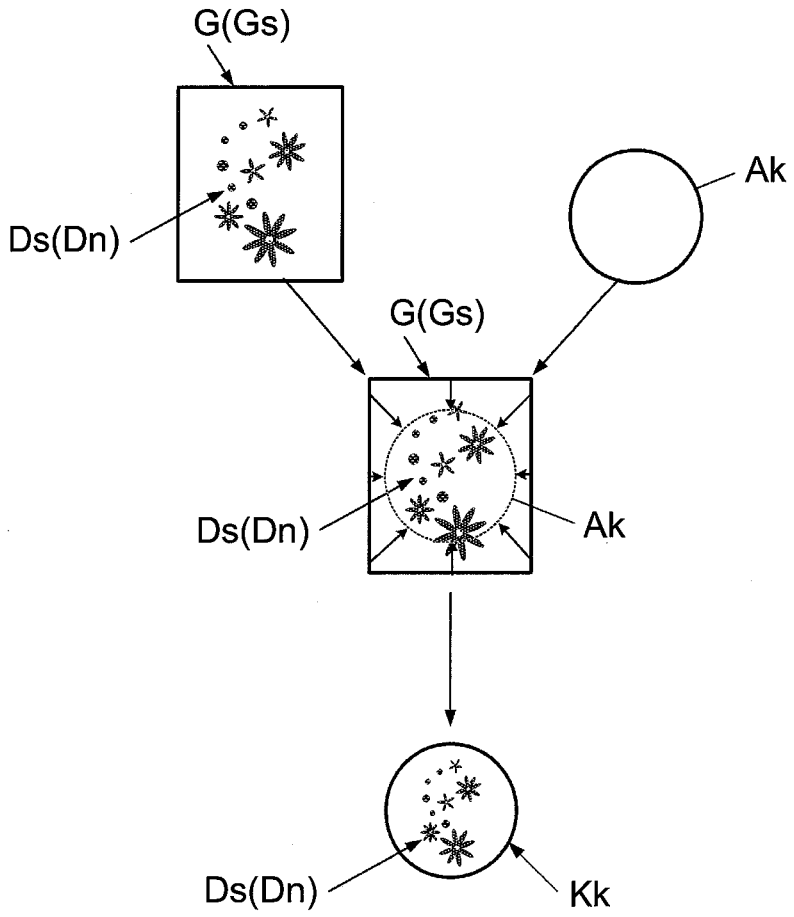
FIG. 13 is an explanation view for explaining generation of an accessory fitting image into a printing surface of decorative part in the first embodiment.

In the embodiment, the print region extracting unit 523 extracts, from the decorative part image obtained by the photographing unit 30, the part printing region Ak (outline of part printing surface Ps and accessory printing region, see FIG. 13) corresponding to the part printing surface Ps included in the decorative part image.

The print region extracting unit 523 precisely extracts the part printing region Ak from the decorative part image input from the photographing control unit 522 on the basis of the difference in color from the printing target placement area 611, for example. The method of extracting the part printing region Ak by the print region extracting unit 523 is not especially limited, nor limited to the example described here.

The fitted image generation unit 524 generates the nail fitted image Gg following the shape of the nail region At from the original image G (nail design original image Gn) of the nail design Dn by fitting the design image (nail design Dn) to be printed on the nail T to the nail region At which is extracted by the print region extracting unit 523.

Figure 11:
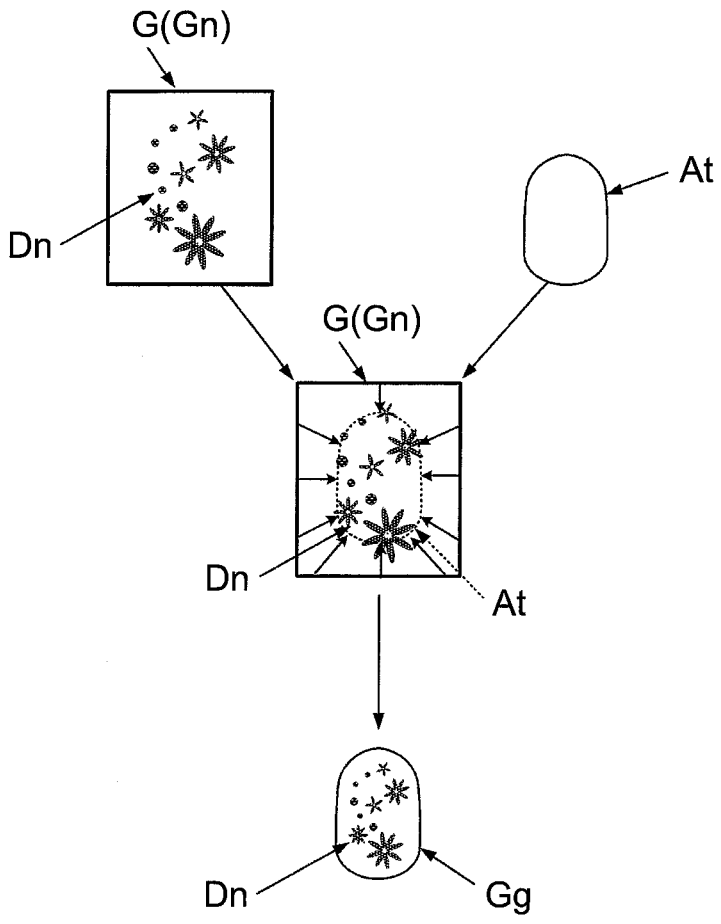
FIG. 11 is an explanation view for explaining generation of a nail fitting image into a nail region in the first embodiment.

FIG. 11 is an explanation view showing generation of the nail fitted image Gg to the nail region At by the fitted image generation unit 524.

The nail fitted image Gg is an image obtained by adjusting the size and the shape of the nail design original image Gn into the size and the shape of the nail region At of the user.

Figure 12:
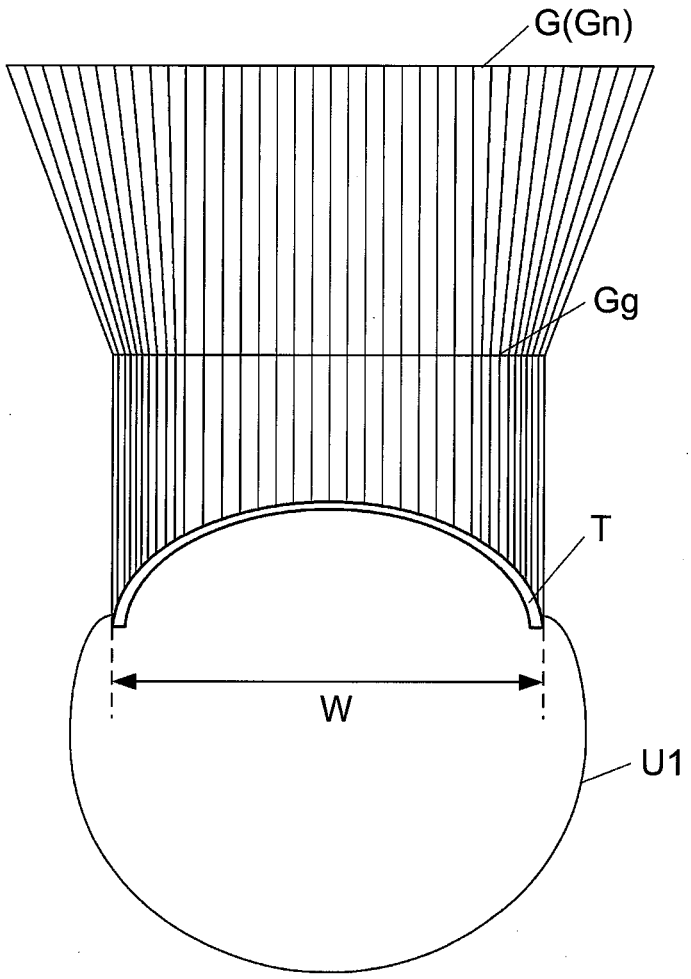
FIG. 12 is an explanation view for explaining a printing pitch of nail printing image in the first embodiment.

As shown in FIG. 12, the size in the width direction of the nail fitted image Gg is nearly the same as the apparent size W in the width direction of the nail T in a plan view.

A person's nail T is curved so as to have increasing distance from the print head 46 in the end portions in the width direction. In order to prevent distortion and weak concentration of the nail design Dn at the end portions in the width direction of the nail T when printing the nail design Dn on the surface of such curved nail T, the fitted image generation unit 524 adjusts so that more pixel data is assigned to the region corresponding to the end portions in the width direction than to the central portion in the width direction of the nail T to generate the nail fitted image Gg as shown in FIG. 12.

Also, the fitted image generation unit 524 generates an accessory fitted image Kk (see FIG. 13) following the shape of the part printing region Ak from the original image G (decorative part design original image Gs) of the decorative part design Ds by fitting the decorative part design Ds into the part printing region Ak which is the part printing surface Ps extracted by the print region extracting unit 523.

The fitted image generation unit 524 reads out and obtains the part data such as shape, size and curvature of the part printing surface Ps from the part data storage unit 512 on the basis of the part number input by the user.

FIG. 13 is an explanation view showing generation of the accessory fitted image Kk to the part printing region Ak by the fitted image generation unit 524.

Here, the design image (decorative part design Ds) to be printed on the part printing surface Ps and the design image (nail design Dn) to be printed on the nail T are the same, and the decorative part design original image Gs and the nail design original image Gn which are respectively the original images G thereof are also the same.

The accessory fitted image Kk is the image obtained by adjusting the size and the shape of the decorative part design original image Gs to the shape, size, curvature and the like of the part printing surface Ps on the basis of the part data which was read out.

The size of the accessory fitted image Kk is nearly the same as the apparent size of the part printing surface Ps of the decorative part Sp in a plan view.

The part printing surface Ps is a curved surface in some cases. In such case, the decorative part design Ds printed on a portion with a large curvature of the part printing surface Ps may have distortion or weak concentration. In order to prevent this, the fitted image generation unit 524 adjusts so that more pixel data is assigned to the region corresponding to the portion with larger curvature of the part printing surface Ps according to the part data (data such as shape, size and curvature of the part printing surface Ps) obtained from the part data storage unit 512, and generates the accessory fitted image Kk.

The printing control unit 525 controls the print head 46 so as to print the design image on the nails T of the printing fingers U1 inserted into the printing finger inserting unit 20*a* and on the part printing surface Ps of the decorative part Sp placed on the accessory holding unit 610 located in the printing finger inserting unit 20*a*.

In the embodiment, in the nail print mode, the printing control unit 525 controls the print head 46 so that the print head 46 performs printing at a smaller printing pitch on the regions corresponding to the both end portions in the width direction than on the central portion in the width direction of the nail T in the nail fitted image Gg.

That is, as shown in FIG. 12, in the nail fitted image Gg, more pixel data is assigned to the region corresponding to the end portions in the width direction than to the region corresponding to the central portion in the width direction of the nail T, and the printing control unit 525 generates the image (nail printing image) for nail printing by adjusting the printing pitch so as to be smaller at the end portions. Then, by outputting the data of the nail printing image to the printing unit 40, printing on the nail T is performed by the print head 46.

In the accessory print mode, when the part printing surface Ps of the decorative part Sp of the accessory S has a curved surface, the printing control unit 525 controls the print head 46 so that the printing pitch of the printing by the print head 46 is smaller as the curvature of the curved surface in the part printing surface Ps is larger.

In the embodiment, the printing control unit 525 generates the image for accessory printing (accessory printing image) by adjusting the printing pitch so that the printing pitch on a portion with a larger curvature is smaller on the basis of the accessory fitted image Kk in which more pixel data is assigned to the portion with a larger curvature than to the portion with a smaller curvature of the part printing surface Ps. Then, by outputting the data of the accessory printing image to the printing unit 40, printing is performed on the part printing surface Ps by the print head 46.

Generation of the nail printing image and the accessory printing image by the printing control unit 525 is not the essential configuration element of the present invention. For example, data of the nail fitted image Gg and the accessory fitted image Kk may be appropriately converted by LUT (Lookup Table) and such like and output to the printing unit 40 to perform print control without separately generating the image data of the nail printing image and the accessory printing image.

In the nail printing image, the degree of fineness of the printing pitch at the end portions and such like are not especially limited. However, when the printing pitch at the central portion in the width direction is 600 dpi, for example, the printing pitch at the left and right end portions is 2400 dpi and the printing pitch at the middle portion between each of the end portions and the central portion is 1200 dpi. The printing pitch may be set to alter at a plurality of levels so as to be gradually smaller as going to the end portions according to the curvature of the surface of the nail T.

The printing pitch is set according to the printing pitch of the print head 46, and when the upper limit of the printing pitch which is printable for the print head 46 is 1800 dpi, for example, the printing pitch at the left and right edge portions is 1800 dpi.

Thus, making the printing pitch small at the region corresponding to the end portions of the nail T, even in a case of printing on the nail T with the end portions curved away from the print head 46, distortion of the nail design Dn is not generated even at the end portions and high-definition image can be printed without lowering the concentration.

Also in the accessory printing image, the degree of fineness of the printing pitch at portions with a large curvature and such like are not especially limited. However, when the printing pitch at the flat portion having no curvature in the part printing surface Ps is 600 dpi, for example, the printing pitch at the portions with the largest curvature in the part printing surface Ps is 2400 dpi and the printing pitch at the middle portion between each of the portions and the flat portion is 1200 dpi.

In the embodiment, the curvature corresponding to the part printing surface Ps is stored in the part data storage unit 512 so as to be associated with the part number, and the setting of the printing pitch is performed on the basis of the curvature.

The printing pitch is set according to the printing pitch of the print head 46, and when the upper limit of the printing pitch which is printable for the print head 46 is 1800 dpi, for example, the printing pitch at the portions with the largest curvature in the decorative part Sp is 1800 dpi.

Thus, making the printing pitch small at the portions with a large curvature in the decorative part Sp, even in a case of printing on the part printing surface Ps with a curved surface, distortion of the decorative part design Ds is not generated and high-definition image can be printed without lowering the concentration.

The tray code reading unit 526 extracts the tray code 601 from the image obtained by the photographing unit 30.

The tray code reading unit 526 also analyzes the extracted tray code 601 and obtains information (tray information) included in the tray code 601.

Next, with reference to FIG. 14, operations of the nail print apparatus 1 in the embodiment will be described.

Figure 14:
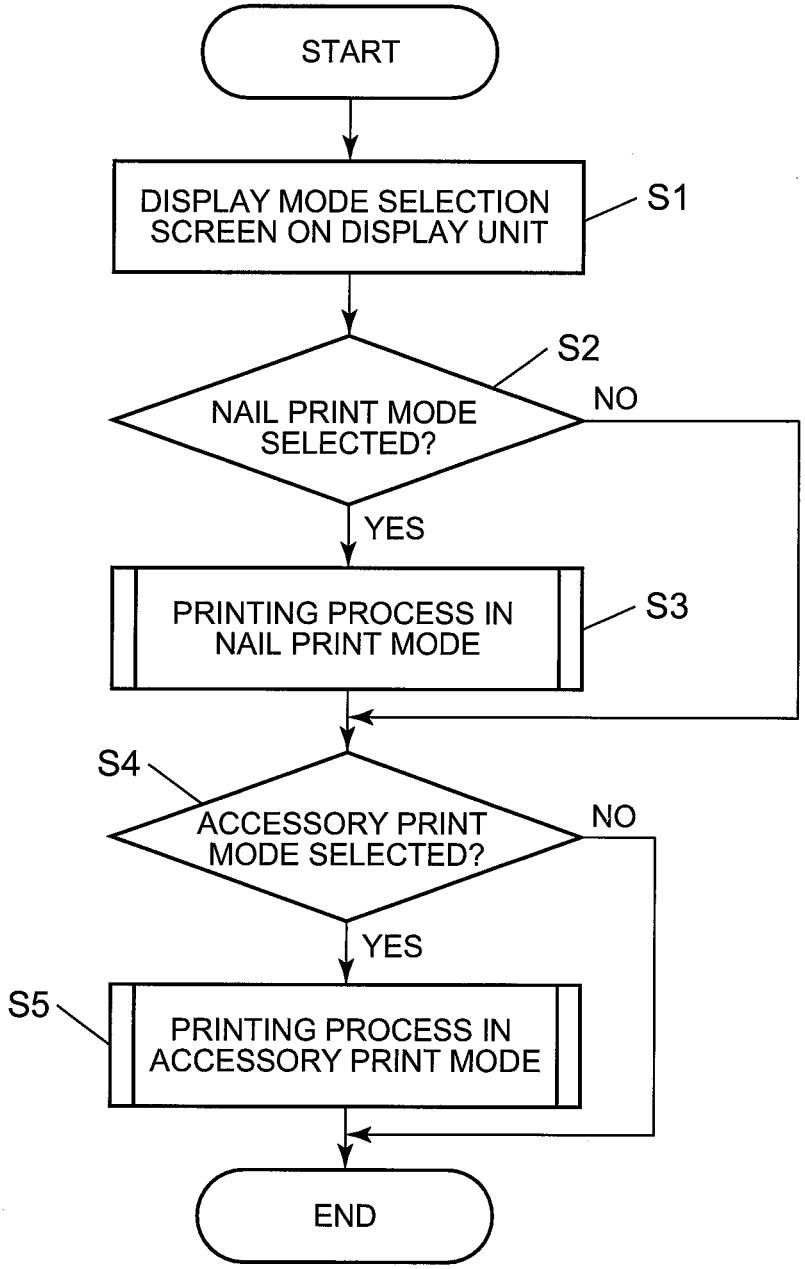
FIG. 14 is a flowchart showing overall flow of printing process in the first embodiment.

FIG. 14 is a flowchart showing the overall flow of printing process in the embodiment.

When the power is turned on and the control device 50 is activated, the display control unit 521 displays a mode selection screen instructing the user to select whether to execute the nail print mode and whether to execute the accessory print mode (step S1).

When the user operates the operation buttons 121 and such like to select whether to execute the nail print mode and whether to execute the accessory print mode, a mode selection instruction signal instructing the selection of mode is output from the operation unit 12 to the control unit 52.

Then, the control unit 52 determines whether the nail print mode is selected on the basis of the mode selection instruction signal (step S2).

If it is determined that the nail print mode is selected (step S2; YES), printing process by the nail print mode is performed (step S3).

If it is determined that the nail print mode is not selected (step S2; NO), printing process by the nail print mode is not performed and the control unit 52 determines whether the accessory print mode is selected on the basis of the mode selection instruction signal (step S4).

If it is determined that the accessory print mode is selected (step S4; YES), printing process in the accessory print mode is performed (step S5).

After the printing process in the accessory print mode is finished, the control unit 52 ends the printing process by the nail print apparatus 1.

If it is determined that the accessory print mode is not selected (step S4; NO), the control unit 52 does not perform printing process in the accessory print mode and ends the printing process by the nail print apparatus 1.

Figure 15:
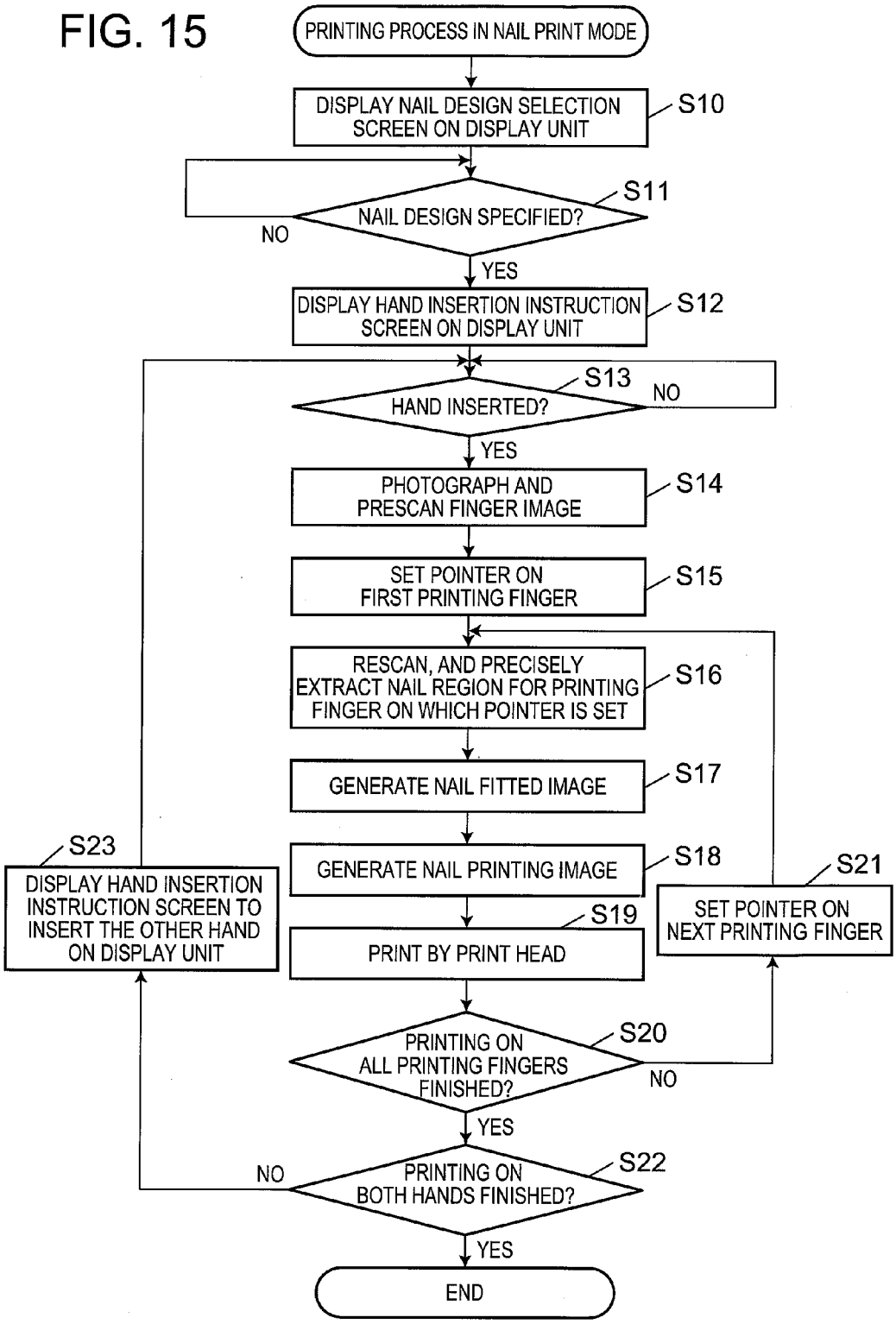
FIG. 15 is a flowchart showing printing process in a nail print mode of the first embodiment.

FIG. 15 is a flowchart showing printing process (step S3 in FIG. 14) in the nail print mode.

In the nail print apparatus 1 of the embodiment, printing is performed on the nails T of a plurality of printing fingers U1 of the left and right hands inserted into the printing finger inserting unit 20*a* (nails Ta of the four fingers of one hand and nail Tb of the thumb of the other hand) at the same time.

Here, "printing at the same time" means printing can be performed continuously without removing the printing fingers U1 which were inserted into the printing finger inserting unit 20*a* at a time.

As shown in FIG. 15, in the nail print mode, the display control unit 521 makes the display unit 13 display the nail design selection screen (not shown in the drawings) instructing selection of the nail design Dn (step S10).

On the nail design selection screen, a decision button for selecting and specifying the nail design Dn by the user is provided, and by touching any of the design image to be printed on the nail T and operating the decision button, the user can select the desired design image and specify the selected design image as the design image (nail design Dn) to be printed on the nail.

The control unit 52 determines whether the nail design Dn is specified (step S11), and if it is determined that the nail design Dn is not specified (step S11; NO), the determination process of step S11 is repeated.

On the other hand, if it is determined that the nail design Dn is specified (step S11; YES), the display control unit 521 makes the display unit 13 display the hand insertion instruction screen instructing insertion of the hand (printing fingers U1) into the printing finger inserting unit 20*a* of the nail print apparatus 1 (step S12).

An undercoat may be applied to the nail T of the user. In such case, it is preferable that the hand (printing fingers U1) is inserted into the printing finger inserting unit 20*a* after drying the applied undercoat.

The photographing control unit 522 makes the photographing unit 30 photograph the inside of the printing finger inserting unit 20*a* as needed, obtains the image and outputs the obtained image to the control unit 52. The control unit 52 determines whether the user's hand (printing fingers U1) is inserted into the printing finger inserting unit 20*a* on the basis of the image output from the photographing control unit 522 (step S13).

If it is determined that the hand (printing fingers U1) is not inserted into the printing finger inserting unit 20*a* (step S13; NO), determination process of step S13 is repeated until the hand is inserted.

On the other hand, if it is determined that the hand (printing fingers U1) is inserted into the printing finger inserting unit 20*a* (step S13; YES), the photographing control unit 522 makes the photographing unit 30 photograph the finger image including the nail regions At of the printing fingers U1 inserted into the printing finger inserting unit 20*a*, and outputs the photographed finger image to the control unit 52.

The control unit 52 prescans the finger image input by the photographing control unit 522, and thereby obtains the number and location information of the inserted printing fingers U1 and preliminarily extracts the appropriate location and range of the nail region At of each of the printing fingers U1 (step S14).

When the prescanning is completed, the control unit 52 sets any one of the printing fingers U1 (the thumb of the right hand located at the right end in FIG. 4A, for example) as a first target, and sets a sight of the camera 32 on the printing finger U1 ("set pointer", step S15 in FIG. 15).

Then, the control unit 52 photographs the printing finger U1 and performs rescanning (step S16). That is, the print region extracting unit 523 precisely extracts the nail region At of the nail T from the finger image of the printing finger U1 obtained by the photographing unit 30.

When the nail region At is extracted, the fitted image generation unit 524 fits the nail design Dn selected by the user into the nail region At in size and such like to generate the nail fitted image Gg (step S17, see FIG. 11).

Furthermore, the printing control unit 525 generates the nail printing image which is adjusted so that the printing pitch of printing by the print head 46 is smaller at the region corresponding to the both end portions in the width direction than at the central portion in the width direction of the nail T in the nail fitted image Gg (step S18, see FIGS. 11 and 12).

Thereafter, the printing control unit 525 controls the print head 46 and performs printing on the portion to be colored by the print head 46 (step S19).

The control unit 52 determines whether printing is finished for all the printing fingers U1 (step S20).

If it is determined that printing is not finished for all the printing fingers U1 (step S20; NO), the sight of the camera 32 is set (that is, "set pointer", step S21) on any of the printing fingers U1 for which printing is not finished (for example, a finger next to the finger which is printed before; the index finger of the left hand in FIG. 4A in a case of printing in order from the right side), and process from step S16 to step S20 is repeated.

On the other hand, if it is determined that printing is finished for all the printing fingers U1 (step S20; YES), it is further determined whether printing is finished for all the fingers of the both hands (step S22), and if printing is finished for all the fingers of the both hands (step S22; YES), printing process ends.

On the other hand, if it is determined that printing is not finished for all the fingers of the both hands (step S22; NO), the hand insertion instruction screen instructing insertion of the finger into the printing finger inserting unit 20*a* is displayed on the display unit 13 (step S23). Then, the process from step S13 to step S22 is repeated.

FIG. 16 is a flowchart showing printing process (step S5 in FIG. 14) in the accessory print mode.

In the nail print apparatus 1 in the embodiment, printing is performed at the same time on the plurality of decorative parts Sp placed on the printing target placement area 611 of the accessory holding unit 610 inserted into the printing finger inserting unit 20*a*.

Here, "printing at the same time" means that printing can be performed continuously without removing the plurality of decorative parts Sp placed on the printing target placement area 611 of the accessory holding unit 610 inserted into the printing finger inserting unit 20*a* at a time.

In the accessory print mode, the display control unit 521 makes the display unit 13 display the accessory holding unit insertion instruction screen instructing insertion of the accessory holding unit 610 in which the decorative parts Sp are placed on the printing target placement area 611 into the printing finger inserting unit 20*a* of the nail print apparatus 1 (step S31).

The photographing unit 30 photographs the inside of the printing finger inserting unit 20*a* as needed and sends the obtained image to the control unit 52, and the control unit 52 determines whether the accessory holding unit 610 is inserted into the printing finger inserting unit 20*a* on the basis of the image output from the photographing unit 30 (step S32).

If it is determined that the accessory holding unit 610 is not inserted into the printing finger inserting unit 20*a* (step S32; NO), the determination process of step S32 is repeated until the accessory holding unit 610 is inserted.

On the other hand, if it is determined that the accessory holding unit 610 is inserted into the printing finger inserting unit 20*a* (step S32; YES), the photographing control unit 522 controls the photographing unit 30 to photograph the decorative part image including the part printing region Ak of the accessory holding unit 610.

The control unit 52 prescans the image and thereby preliminarily extracts the number of the decorative parts Sp, approximate location, range and such like of each of the decorative parts (step S33).

At this time, the display control unit 521 may display the prescanned image on the display unit 13. Thus, the user visually confirms the tray number 602 and can confirm whether the accessory holding unit 610 which is currently inserted into the printing finger inserting unit 20*a* is the desired accessory holding unit 610.

When the prescanning is completed, the tray code reading unit 526 extracts the tray code 601 from the image obtained by the photographing unit 30. The tray code reading unit 526 reads out the extracted tray code 601 and obtains the information included in the tray code 601 (tray information) (step S34).

Next, the display control unit 521 makes the display unit 13 display the tray number 602 included in the obtained tray information and display the confirmation instruction screen making the user confirm whether the accessory holding unit 610 is surely the desired accessory holding unit 610 (step S35).

The user confirms the confirmation instruction screen and performs operations of approving the confirmed contents such as operation of "OK button" if there is no mistake in the contents.

If the accessory holding unit 610 which is inserted into the printing finger inserting unit 20*a* is not the desired one, the user performs operation of not approving the confirmed contents such as the operation of "NO button".

Next, the control unit 52 determines whether the accessory holding unit 610 which is inserted into the printing finger inserting unit 20*a* is the desired one, that is, whether the user performs operation of approving the confirmed contents or operation of not approving from the operation unit 12 and such like (step S36).

If it is determined that the user operates not to approve the confirmed contents, that is, if it is determined that the accessory holding unit 610 inserted into the printing finger inserting unit 20*a* is not the desired one (step S36; NO), the display control unit 521 makes the display unit 13 display the screen instructing the removal of the accessory holding unit 610 from the printing finger inserting unit 20*a* (step S37).

Then, the photographing unit 30 photographs the inside of the printing finger inserting unit 20*a* as needed and sends the obtained image to the control unit 52, and the control unit 52 determines whether the accessory holding unit 610 is removed from the printing finger inserting unit 20*a* on the basis of the image output from the photographing unit 30 (step S38).

If it is determined that the accessory holding unit 610 is not removed from the printing finger inserting unit 20*a* (step S38; NO), the determination process of step S38 is repeated until the accessory holding unit 610 is removed.

If it is determined that the accessory holding unit 610 is removed from the printing finger inserting unit 20*a* (step S38; YES), the process returns to step S31, and the display control unit 521 displays the accessory holding unit insertion instruction screen and instructs the user to insert the accessory holding unit 610.

If the user operates to approve the confirmed contents, that is, if it is determined that the accessory holding unit 610 inserted into the printing finger inserting unit 20*a* is the desired one (step S36; YES), the display control unit 521 makes the display unit 13 display the part number input screen (step S39).

The user inputs the part number identifying each of the decorative parts placed on the printing target placement area 611 by operating the operation button 121. The part number input by the user is output from the operation unit 12 to the control unit 52.

The control unit 52 determines whether the user inputs the part number by whether the part number is input from the operation unit 12 (step S40).

If it is determined that the user does not input the part number, that is, if the part number is not input to the control unit 52 (step S40; NO), the determination process of step S40 is repeated until the user inputs the part number.

If it is determined that the user inputs the part number, that is, if the part number is input to the control unit 52 (step S40: YES), the control unit 52 obtains the part data including the part data such as the shape, size of the part printing surface Ps and the curvature of the surface to be printed (part printing surface Ps) from the part data storage unit 512 on the basis of the part number (step S41, obtain part data).

Then, the display control unit 521 makes the display unit 13 display the decorative part design selection screen for the user to select the design image (decorative part design Ds) to be printed on the accessory (step S42).

On the decorative part design selection screen, the decision button for the user to select and specify the decorative part design Ds is provided and the decorative part design Ds is specified by the user touching any of the design images (nail design Dn and related design image R) to be printed on the decorative part Sp and pushing the decision button.

On the decorative part design selection screen, by the user operating the operation buttons 121 and such like, the decorative part design Ds may be arranged by changing the background color of the decorative part design Ds and the number and size of the pattern (flower pattern, for example) included in the decorative part design Ds.

If both of the nail print mode and the accessory print mode are selected, the related design R corresponding to the nail design Dn may be specified as the decorative part design Ds as default. Thus, the user can avoid the trouble of selecting and arranging the design image, which is convenient. In such case, the related design image R may be displayed and the screen asking the user for approval may be displayed on the display unit 13.

The control unit 52 determines whether the decorative part design Ds to be printed on the decorative part Sp is specified (step S43).

If it is determined that the decorative part design Ds is not specified (step S43; NO), the determination process of step S43 is repeated until the decorative part design Ds is specified.

On the other hand, if it is determined that the decorative part design Ds is specified (step S43; YES), the control unit 52 sets any of the decorative parts Sp as the first target and sets the sight of the camera 32 on the decorative part Sp ("set pointer" step 44).

Then, the decorative part Sp is photographed and re-scanned (step S45). That is, the print region extracting unit 523 precisely extracts the part printing region Ak from the decorative part image of the decorative part Sp obtained by the photographing unit 30.

When the part printing region Ak is extracted, the fitted image generation unit 524 fits the decorative part design Ds selected by the user into the part printing region Ak to adjust the size and such like, and generates the accessory fitted image Kk (step S46, see FIG. 13).

Next, the printing control unit 525 generates the accessory printing image which is adjusted on the basis of the curvature of the part printing surface Ps included in the part data. Here, the printing control unit 525 generates the accessory printing image which is adjusted so that printing is performed by the print head 46 at a smaller printing pitch on the region corresponding to the end portions than on the central portion of the decorative part Sp in the accessory fitted image Kk (step S47).

Thereafter, the printing control unit 525 prints the adjusted accessory printing image on the part printing surface Ps with print head 46 (step S48).

The control unit 52 determines whether printing is finished for all the decorative parts Sp (step S49).

If it is determined that printing is not finished for all the decorative parts Sp (step S49; NO), the control unit 52 sets the sight of the camera 32 (that is, "sets pointer" in step S50) on any of the decorative part Sp for which printing is not finished (for example, the heart-shaped decorative part Sp in FIG. 6A in a case of printing in order from the left side), and repeats the process from step S45 to step S49.

On the other hand, if it is determined that printing is finished for all the decorative parts Sp (step S49; YES), printing process in the accessory print mode ends.

Thereafter, the user may remove the decorative parts Sp from the accessory holding unit 610 to apply the coating to the part printing surfaces Ps. Though the coating is not especially limited, preferable coating is a coating which prevents the damage to the printed decorative part design Ds, resists water and has an effect of polishing.

Then, as shown in FIGS. 17A and 17B, the printed decorative parts Sp are attached to the accessory frame Sf such as a pierced earring by the user and the accessory S is completed.

As described above, since only the decorative parts Sp removed from the accessory S can be placed on the printing target placement area 611 in the embodiment, printing is possible even in a case where the accessory S has a frame with decoration such as rings, balls and rhinestones and an attachment C (see FIG. 18B) and the accessory as a whole cannot be inserted into the printing finger inserting unit 20*a*, for example.

Also, since only the decorative parts Sp are placed on the printing target placement area 611, the decorative part design Ds can be printed without making the decoration, attachment C and such like dirty.

Thus, for example, various types of accessories S such as rings, earrings, a pendant, a strap, a key chain, triple pierced earrings, a bracelet, a brooch, an obi clip and a hair clasp can be made with a design which has unity with the nail design Dn, and various fashion can be enjoyed.

As described above, according to the first embodiment, the nail design Dn printed on the nails can be printed on the decorative parts Sp by inserting the accessory holding unit 610 in which the decorative parts Sp are placed on the printing target placement area 611 into the printing finger inserting unit 20*a*.

Figure 18A:
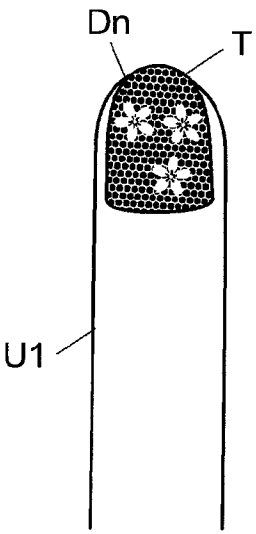
FIG. 18A is an explanation view showing an example of a nail design.
Figure 18B:
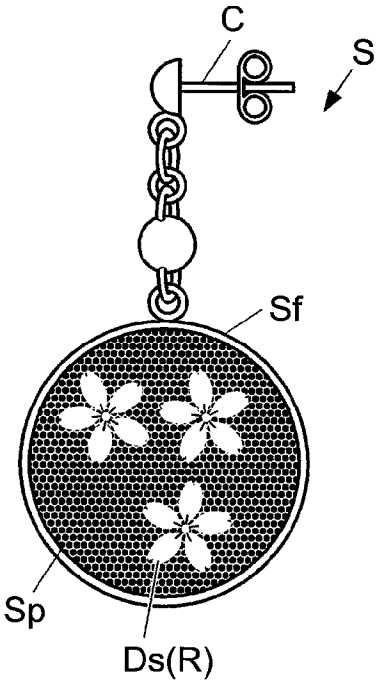
FIG. 18B is an explanation view showing an example of a decorative part on which the nail design of FIG. 18A is printed.

Thus, as shown in FIGS. 18A and 18B, a sense of unity can be easily provided between the design image printed on the nails and the accessory S, for example, by easily making the accessory S such as pierced earrings which has the same design as the nails, and fashion can be enjoyed.

Figure 18C:
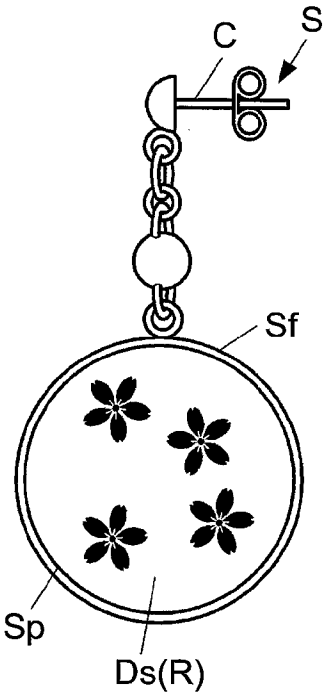
FIG. 18C is an explanation view showing an example of a decorative part on which the color-inverted design of the nail design of FIG. 18A is printed.
Figure 18D:
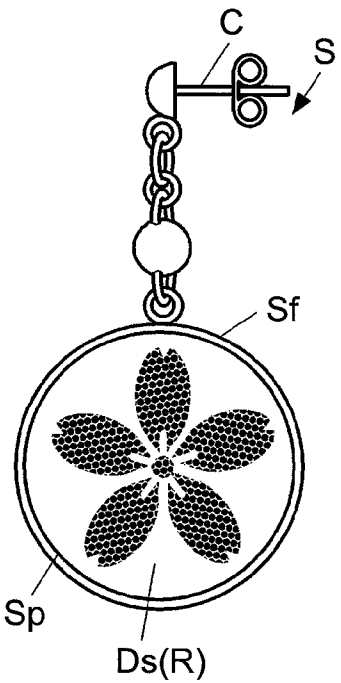
FIG. 18D is an explanation view showing an example of the decorative part on which a design image related to the nail design of FIG. 18A is printed.
Figure 19:
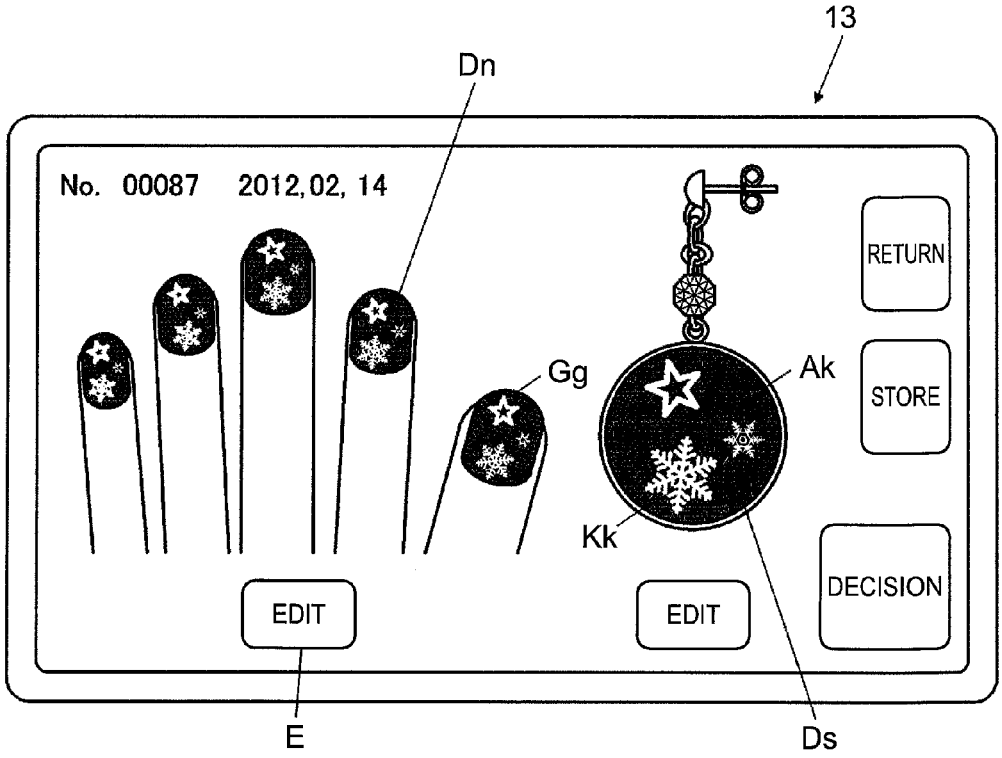
FIG. 19 is an explanation view showing an example of a display unit displaying an image of nails on which a nail design is printed and an accessory on which a decorative part design is printed.

Furthermore, as shown in FIGS. 18C and 18D, a related design image R which is related to the nail design Dn in pattern, color and atmosphere can be printed on the decorative part Sp, and thus a variety of fashion can be casually enjoyed according to the user' s feeling and time, place and occasion.

In addition, since the user does not need to select the nail design Dn which suits the design of the accessory S which the user already has, the user can freely select the nail design Dn, which is convenient and makes fashion more enjoyable.

Furthermore, by placing the decorative part Sp on the printing target placement area 611 of the accessory holding unit 610, the position and height of the part printing surface Ps of the decorative part Sp becomes the position and the height which are printable for the print head 46. Thus, printing can be performed on the decorative parts Sp without a special configuration which is adjustable in the height direction of the print head, and the apparatus can be manufactured easily with the suppressed manufacturing cost.

Also, since the accessory holding unit 610 is provided so as to be inserted into and removed from the printing finger inserting unit 20*a*, the accessory holding units 610 can be changed according to the height of the decorative parts Sp. Thus, printing can be performed on the part printing surfaces Ps of various heights and a variety of accessories S can be printed, which makes fashion more enjoyable.

The printing control unit 525 generates the accessory printing image adjusted on the basis of the curvature of the printing surface and performs printing on the decorative parts Sp on the basis of the image. Thus, even on a decorative part Sp with a curved surface, printing can be performed neatly without distortion of the decorative part design Ds nor weak concentration. Thus, the nail print apparatus 1 can print the design image on the decorative parts Sp with various shapes.

For example, printing can be performed on not only a circle shape but also the decorative parts Sp with oval or heart shapes as shown in FIG. 6A.

Also, since the printing pitch is adjusted according to the curvature, the image which is not distorted can be neatly printed on both a curved surface with a large curvature and a plain surface without curvature. Thus, the user can enjoy fashion more since printing can be performed on the decorative parts with various curvatures and the user can wear various accessories S which are fitted to the nail design Dn.

In the embodiment, a case where the printing target placement area 611 is a concave portion of nearly rectangle in a plan view which is formed in the back side of the accessory holding unit 610 is taken as an example. However, the position, size, shape and such like of the printing target placement area 611 are not especially limited as long as the shape thereof is such that the surfaces to be printed (part printing surfaces Ps) of the decorative parts Sp are placed at the position and height (here, the height which is nearly the same as the nail T when the printing fingers U1 are placed on the finger placement unit 20*c*) which are printable for the print head 46. For example, the printing target placement area 611 may be a concave portion of nearly rectangle in a plan view and may be a convex portion which raises the part printing surfaces Ps that are low up to the printable height.

Though a case where the entire printing target placement area 611 is formed to be flat is described as an example in the embodiment, the shape of the printing target placement area 611 is not limited to this, and may be formed in a stepped shape having a plurality of steps with different heights. If the printing target placement area 611 is formed in a stepped shape, decorative parts Sp with different heights (thickness) can be held at the printable position and height by a single accessory holding unit 610, and thus the decorative parts Sp with different heights of printing surfaces can be printed at a time, which is preferable.

Furthermore, the height may be adjusted by laying a plurality of accessory holding units 610. When the height can be adjusted by laying the accessory holding units 610, part printing surfaces Ps of decorative parts Sp with various heights (thickness) can be fitted to the printable height according to the types and number of the laid accessory holding units 610, which is convenient.

Though the embodiment is described by taking, as an example, a case where selection of nail design Dn and decorative part design Ds is performed in the nail print mode and the accessory print mode (step S10 in FIG. 15, step S42 in FIG. 16), the present invention is not limited to this. These selection may be performed when the mode selection screen is displayed (step S1 in FIG. 14).

In such case, it is preferable that the user also inputs the part number and the fitted image generation unit 524 generates the nail fitted image Gg in step S17 and accessory fitted image Kk in step S46.

In such case, the display control unit 521 may display the nail fitted image Gg and the accessory fitted image Kk on the display unit 13 before printing and make the user confirm the image of the nail design Dn and the decorative part design Ds to be printed. By such configuration, the user can consider and confirm the nail design Dn and the decorative part design Ds which suit the clothes, bag and such like and time, place and occasion before performing printing.

Furthermore, an image of an accessory S which the user previously has may be stored in the storage unit 51, and the display control unit 521 may synthesize the image and the accessory fitted image Kk and display images of the nail T on which the nail design Dn is printed and of the decorative part Sp on which the decorative part design Ds is printed on the display unit 13 before printing. Thus, the user can imagine a printed nail design Dn and the accessory S more easily.

Figure 20:
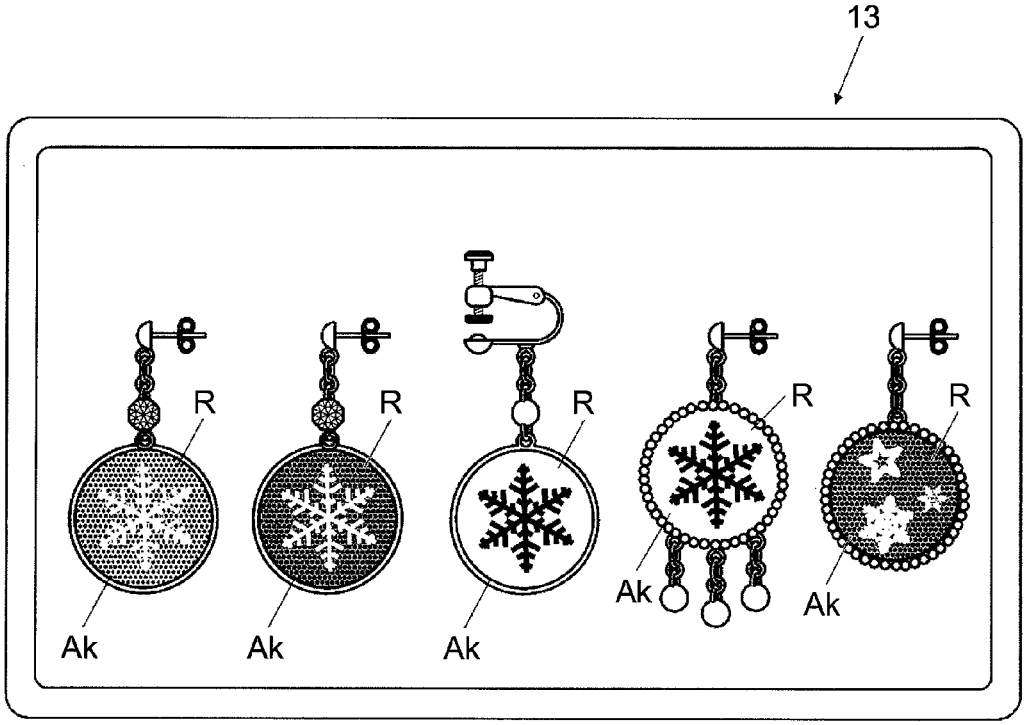
FIG. 20 is an explanation view showing an example of a display unit displaying an image of accessories on which decorative part designs with different colors of background and pattern are printed.

In such case, when edit buttons F are operated, for example, the display control unit 521 may make the display unit 13 display related design images R as shown in FIG. 20 in which the decorative part design Ds is altered in background color and color of pattern (flower pattern, for example) in the accessory frame Sf of the accessory which the user previously has. By such operation, the user can consider and confirm the nail design Dn and decorative part design Ds which suit the clothes, bag and such like and time, place and occasion before printing.

In this case, the user may change the design by a predetermined operation if the user determines that the design is not the desired one as a result of the confirmation. Thus, the accessory S which has unity with not only the nail design Dn but also the entire clothes and such like of the user can be made, which is convenient.

Second Embodiment

Next, with reference to FIGS. 21A, 21B and 22, the second embodiment of a nail print apparatus according to the present invention will be described.

Since the embodiment is different from the first embodiment only in the configuration of accessory holding unit 620, differences from the first embodiment will be especially described hereinafter.

Figure 21B:
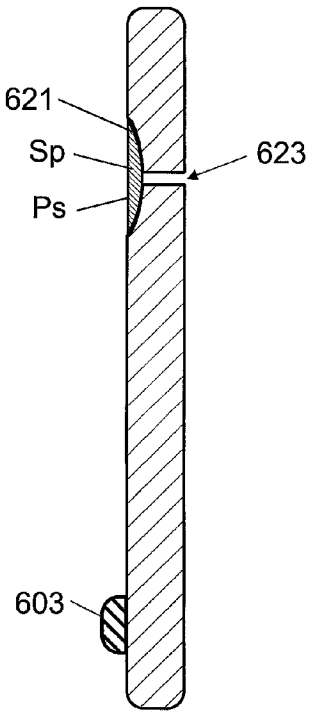
FIG. 21B is a sectional view of the accessory holding unit of FIG. 21A along the line B-B.
Figure 21A:
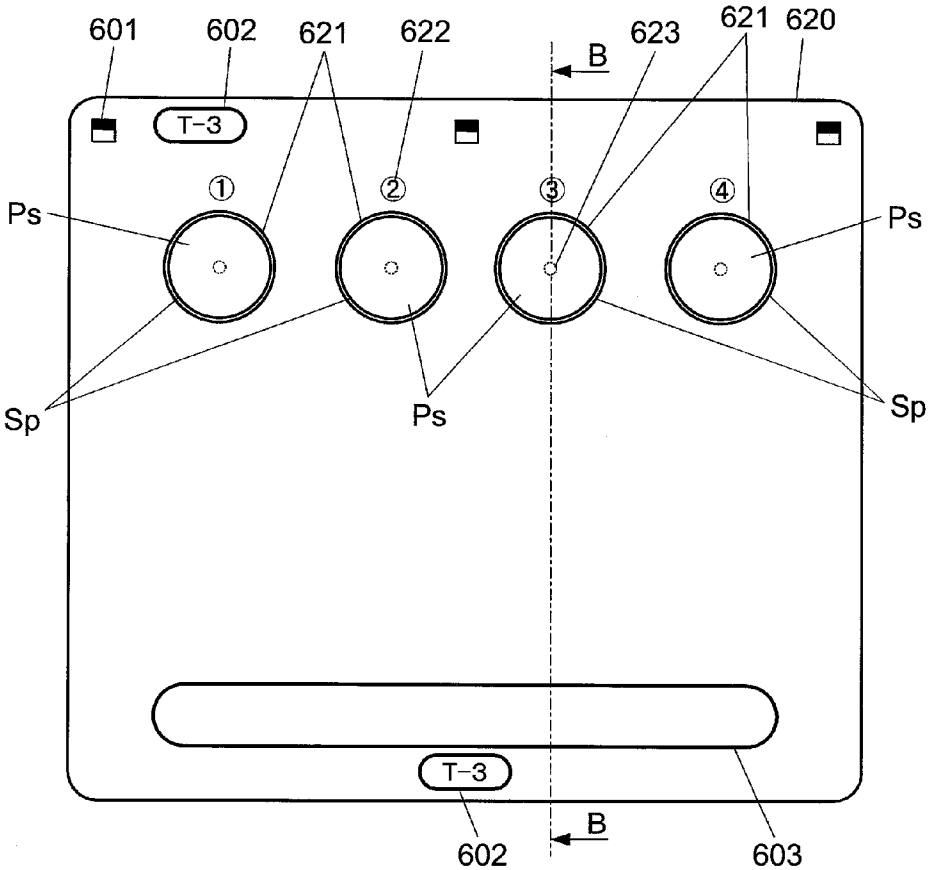
FIG. 21A is a plan view of an accessory holding unit in a second embodiment.

FIG. 21A is a plan view of the accessory holding unit 620 in the second embodiment.

FIG. 21B is a sectional view of the accessory holding unit 620 in FIG. 21A along the line B-B.

A printing target placement area 621 in the second embodiment is different from the printing target placement area 621 in the first embodiment in that a plurality of printing target placement areas 621 are formed to be curved corresponding to the shape of the surface (part surface) of each of the decorative parts Sp as shown in FIG. 21B, for example.

An accessory holding unit number 622 corresponding to each of the printing target placement areas 621 is assigned to the printing target placement area 621.

In the embodiment, as shown in FIG. 21A, a transparent decorative part Sp removed from the accessory S is placed on the printing target placement area 621 with the surface side (part surface side) down. Thus, in the embodiment, the back surface of the transparent decorative part Sp is the part printing surface Ps.

Thus, the nail print apparatus 1 in the embodiment prints the decorative part design Ds on the back surface of the decorative part Sp. Thus, when the decorative part Sp is attached to the accessory S, the part printing surface Ps is not the surface of the accessory S. Thus, the printed decorative part design Ds is difficult to damage even without applying the coating to the decorative part design Ds printed on the part printing surface Ps, which saves trouble and is convenient.

Though the material of decorative part Sp is not especially limited, it is preferable that the material is formed of transparent resin which is glossy and resistant to damages, for example.

The number of the printing target placement areas 621 is not limited to four as in the illustrated example, and may be larger and smaller than four.

The information (tray information) included in the tray code 601 in the embodiment further includes the accessory holding unit number 622 and the position coordinate (that is, part printing region Ak) of each of the printing target placement areas 621 corresponding to each of the accessory holding unit number 622.

The print region extracting unit 523 in the embodiment obtains the part printing region Ak from the tray information on the basis of the accessory holding unit number 622.

Thus, since the print region extracting unit 523 does not extract the part printing region Ak from the decorative part image in the nail print apparatus 1 in the embodiment, surface treatment such as preliminary coloring is not needed even for a transparent decorative part Sp.

Thus, printing can be performed without surface treatment even for a transparent decorative part Sp, which saves trouble and is convenient.

As shown in FIG. 21B, a hole unit 623 which penetrates the accessory holding unit 620 from the upper surface to the lower surface is formed in the printing target placement area 621 in the embodiment. Thus, the decorative part Sp is not attached firmly to the printing target placement area 621, and the user can easily remove the decorative part Sp from the printing target placement area 621. Since the printed decorative part Sp and such like can also be lifted up by a thin pin and such like through the hole unit 623 from the lower surface, the user can easily remove the decorative part Sp from the printing target placement area 621, which is convenient.

Forming the hole unit 623 in the printing target placement area 621 is not an essential configuration element of the present invention, and the hole unit 623 may not be provided.

Since the other configurations are the same as those described in the first embodiment, the explanation thereof is omitted with the same reference numerals assigned to the same members.

Next, with reference to FIG. 22, process in the accessory print mode in the second embodiment will be described.

Figure 22:
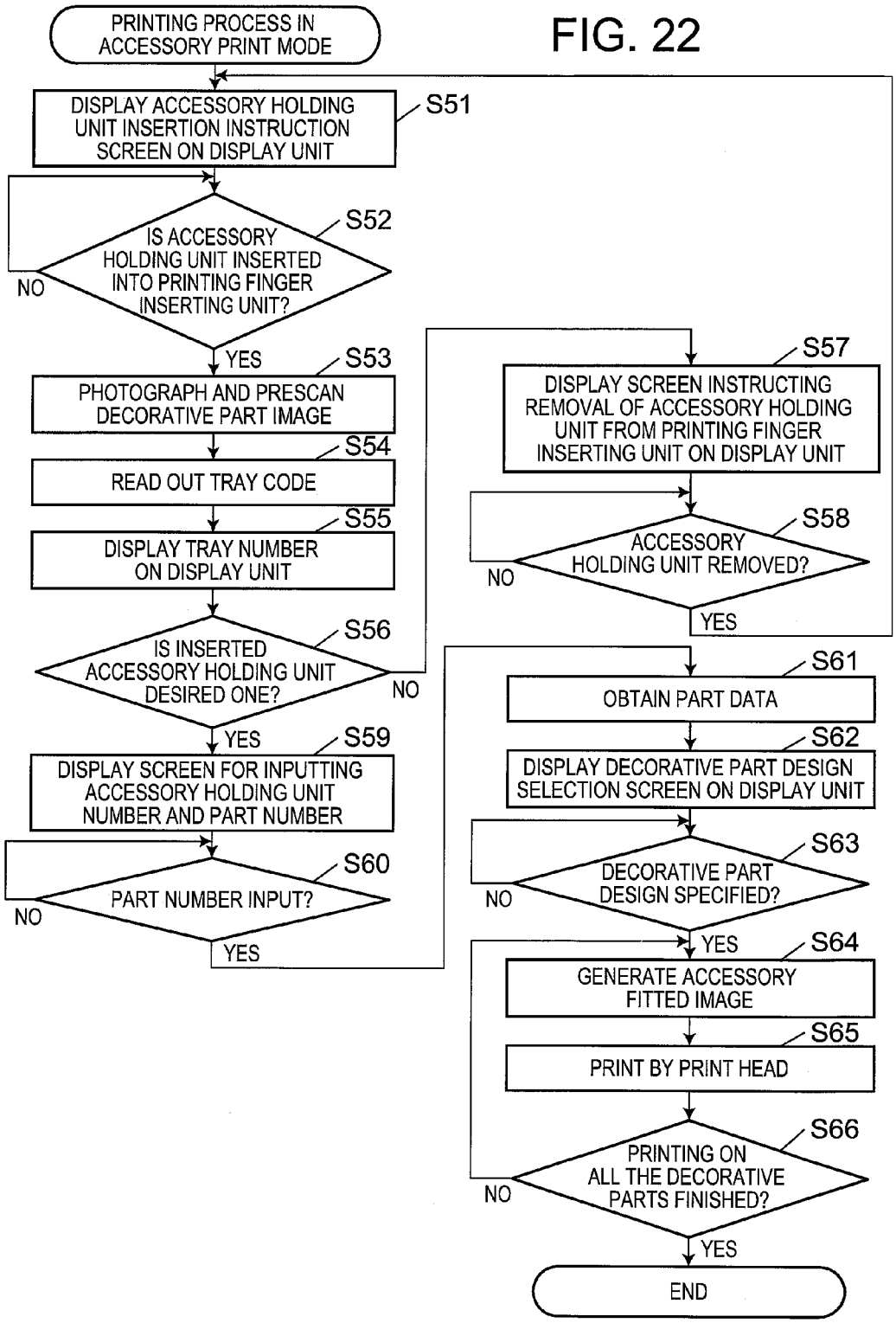
FIG. 22 is a flowchart showing printing process in an accessory print mode in the second embodiment.

FIG. 22 is a flowchart showing process in the accessory print mode in the second embodiment.

Since the process from step S51 to step S58 is similar to that of step S31 to step S38 in the first embodiment, the explanation of overlapped part is omitted.

If the user operates to approve the confirmed contents and the control unit 52 determines that the accessory holding unit 620 inserted into the printing finger inserting unit 20*a* is the desired one (step S56; YES), the display control unit 521 makes the display unit 13 display a screen for inputting the accessory holding unit number 622 of the placed decorative part Sp and the part number identifying the decorative part Sp (step S59).

By operating the operation buttons 121, the user inputs the accessory holding unit number 622 of the placed decorative part Sp and the part number identifying the decorative part Sp.

The operation unit 12 outputs the accessory holding unit number 622 on which the decorative part Sp is placed input by the user and the part number identifying the decorative part Sp to the control unit 52 so as to be associated with each other.

Since the process from step S60 to step S62 thereafter is similar to the process from step S40 to step S42 in the first embodiment, the explanation thereof is omitted.

The control unit 52 determines whether the decorative part design is specified (step S63).

If it is determined that the decorative part design is specified (step S63; YES), the print region extracting unit 523 obtains the part print region Ak from the tray information on the basis of the accessory holding unit number 622.

Then, the fitted image generating unit 524 fits the design image to be printed on the accessory which is selected by the user into the part printing region Ak to adjust the size and such like, and generates the accessory fitted image Kk (step S64).

In the embodiment, since the back surface of the decorative part Sp, that is, a flat surface without a curvature is the part printing surface Ps, correction based on the curvature of the decorative part design Ds is not performed.

Hereinafter, since the process from step S65 to step S66 is the same as the process from step S48 to step S49 in the first embodiment, the explanation thereof is omitted.

The control unit 52 determines whether printing is finished for all the decorative parts Sp (step S66), and if it is determined that printing is not performed for all the decorative parts Sp (step S66; NO), the process from step S64 is performed on any of the decorative parts Sp for which printing is not finished.

On the other hand, if it is determined that printing is finished for all the decorative parts Sp (step S66; YES), printing process in the accessory print mode ends.

Since the other points are similar to those of the first embodiment, the explanation thereof is omitted.

The nail print apparatus 1 in such configuration can also have the same effect as that of the nail print apparatus 1 in the first embodiment.

Though the tray information is described to include the position coordinate (that is, part printing region Ak) of each of the printing target placement areas 621 corresponding to each of the accessory holding unit numbers 622, the present invention is not limited to this and the tray information may not include the part printing region Ak.

In such case, for example, it is preferable that the part printing region Ak is stored in the storage unit 51 or the like so as to be associated with the accessory holding unit number 622 for each type of the accessory holding units 610 corresponding to the part printing region Ak.

Third Embodiment

Next, with reference to FIGS. 23A to 25, the third embodiment of nail print apparatus according to the present invention will be described.

Since only the configuration of the accessory holding unit in the embodiment is different from those of the first embodiment and such like, hereinafter, differences from the first embodiment and such like will be especially described.

Figure 23B:
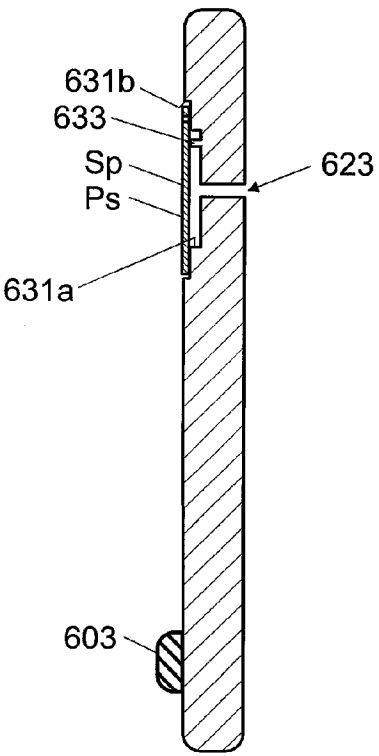
FIG. 23B is the accessory holding unit of FIG. 23A along the line C-C.
Figure 23A:
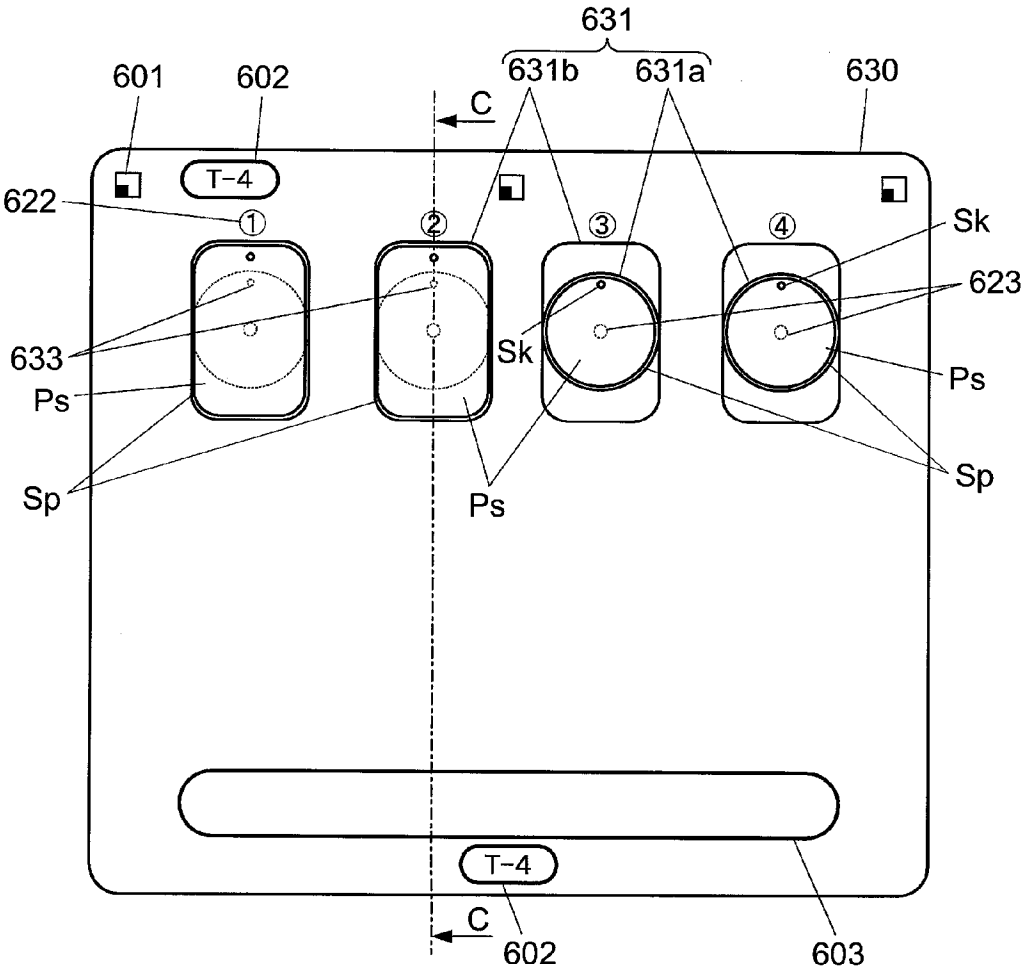
FIG. 23A is a plan view of an accessory holding unit in a third embodiment.

FIG. 23A is a plan view of the accessory holding unit 630 in the third embodiment.

FIG. 23B is a sectional view of the accessory holding unit 630 in FIG. 23A along the line C-C.

The decorative part Sp to be printed by the nail print apparatus 1 in the third embodiment is a transparent flat plate (see FIGS. 23A, 23B and 25) which includes a hole unit Sk formed so as to penetrate in the thickness direction.

Figure 25:
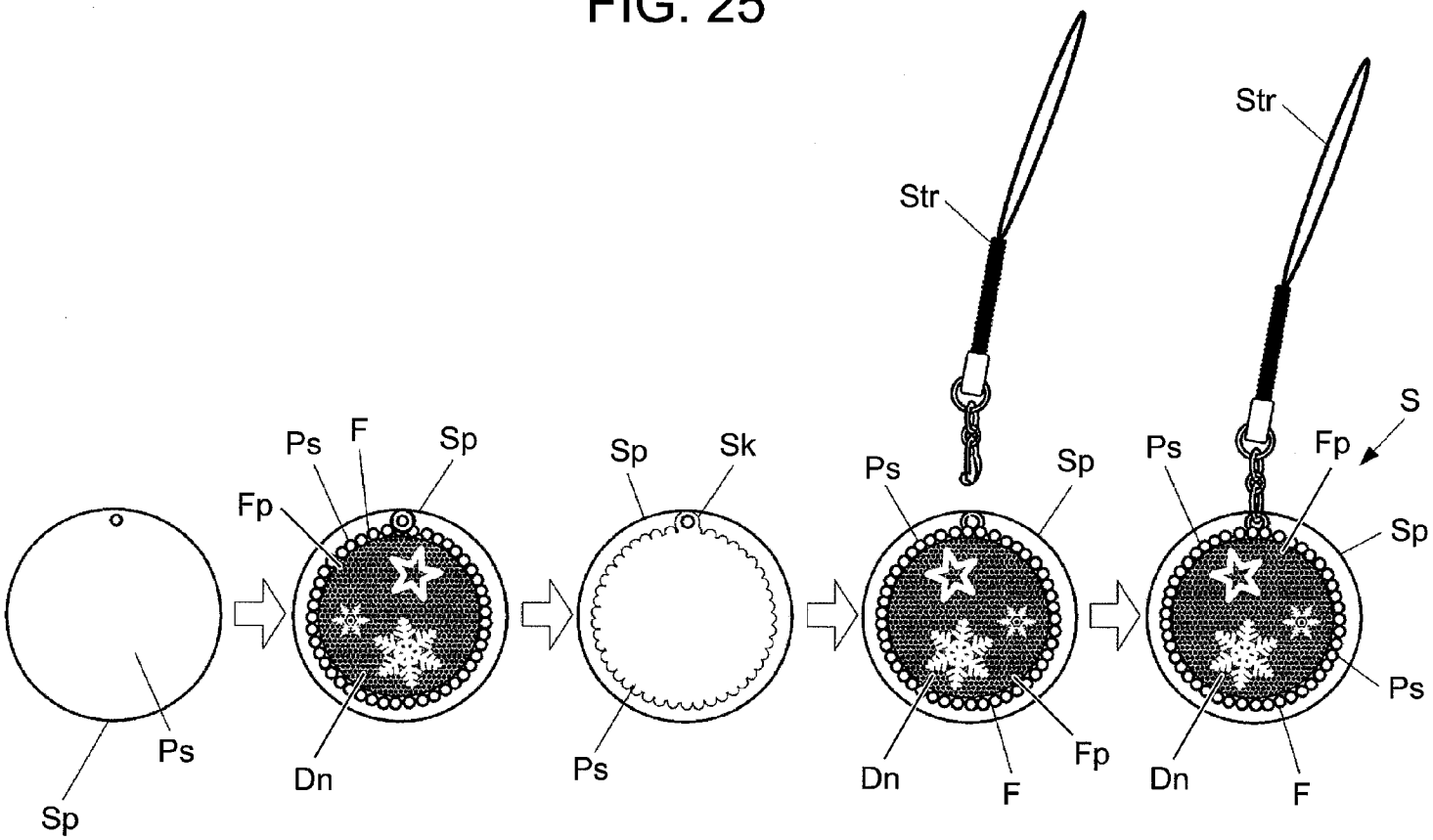
FIG. 25 is an explanation view for explaining a printing procedure of a decorative part in the third embodiment.

On the decorative part Sp, a decorative part design Ds in which the design image and an after-mentioned frame design image F are superimposed is printed (see FIG. 25).

A strap Str and such like which includes a clasp such as a snap swivel and is easy to attach and detach is attached, at the hole unit Sk, to the decorative part Sp on which the decorative part design Ds is printed, and an accessory S is obtained.

In the nail print apparatus 1 of the embodiment, since such transparent resin plate is made to be an accessory S, an accessory S with very low price which does not use metal or decoration can be made. Thus, many types and a large number of accessories S can be casually made and furthermore, the accessories do not place a burden on ears when they are earrings or such like since they are thin and very light. In addition, since the plate is even, hair, clothes, scarfs, mufflers and such like do not get tangled in it, the plate does not damage a mobile phone, a digital camera, a purse, a bag and such like in a case where it is a strap Str, a netsuke, marker and such like, and it does not rust. Thus, the accessory S is easy to carry around and store, which is convenient.

The printing target placement area 631 in the third embodiment may include an accessory positioning pin 633 which can be fitted to the hole unit Sk of the decorative part Sp as shown in FIG. 23A.

By fitting into the hole unit Sk of the decorative part Sp, the accessory positioning pin 633 fixes the decorative part Sp and furthermore decides the direction of decorative part Sp (for example, top and bottom).

Thus, the top-and-bottom direction can be easily and surely decided to perform printing even on a circular decorative part Sp which is difficult to determine for the top-and-bottom direction.

Also, the printing target placement area 631 does not need to be very deep since a flat plate is placed thereon, and thus, as in the illustrated example, a printing target placement area 631*b* of nearly rectangle corresponding to the decorative part Sp on which a rectangle decorative part Sp can be placed may be provided over the upper surface of a circular printing target placement area 631*a*.

In the following description, printing is to be performed on a circular decorative part Sp and the printing target placement area 631 in the embodiment indicates the circular printing target placement area 631*a*.

In the embodiment, the decorative part design selection screen for a user to select the decorative part design Ds and the frame design image F is displayed on the display unit 13.

In the embodiment, image data of the frame design image F such as a metal frame, decoration rhinestone and pearl representing the accessory S (see FIG. 25) is further stored in the design data storage unit 511. The frame design image F includes a region (frame printing region Fp) on which the decorative part design Ds is to be printed. The frame printing region Fp is stored in the design data storage unit 511 so as to be associated with the frame design image F.

In the embodiment, the fitted image generation unit 524 fits the size and shape of the frame design image F selected by the user into the size and shape of the part printing region Ak.

The fitted image generation unit 524 fits the size of the decorative part design Ds into the frame printing region Fp of the frame design image F which was fitted in size and such like.

The fitted image generation unit 524 generates the accessory fitted image Kk by superimposing the decorative part design Ds on the frame printing region Fp of the frame design image F.

In the embodiment, since the decorative part Sp is a flat plate, the flat surface without a curvature is the part printing surface Ps. Thus, the fitted image generation 524 does not perform correction based on the curvature of the decorative part design Ds when generating the accessory fitted image Kk.

Furthermore, in the embodiment, the printing control unit 525 creates a mirror-reversed image (called back surface printing image, see FIG. 25) of the accessory fitted image Kk (called surface printing image) and prints the back surface printing image on the part printing surface Ps with the print head 46.

After printing the back surface printing image on the part printing surface Ps, the printing control unit 525 performs covering process of performing printing on the part printing surface Ps with the print head 46 so as to cover the back surface printing image printed on the part printing surface Ps.

Thereafter, the printing control unit 525 prints the accessory fitted image Kk (surface printing image) on the part printing surface Ps which is cover-processed.

Though the color of ink used for covering process is not especially limited, it is preferable that the covering process is performed with white ink, for example, so as not to influence the color tone of the surface printing image since the accessory fitted image KK (surface printing image) is further printed on the cover-processed surface.

Since the other configurations are similar to that described in the first embodiment or the second embodiment, the explanation thereof is omitted with same reference numerals provided to the same members.

Next, with reference to FIGS. 24 and 25, the accessory print mode in the embodiment will be described.

Figure 24:
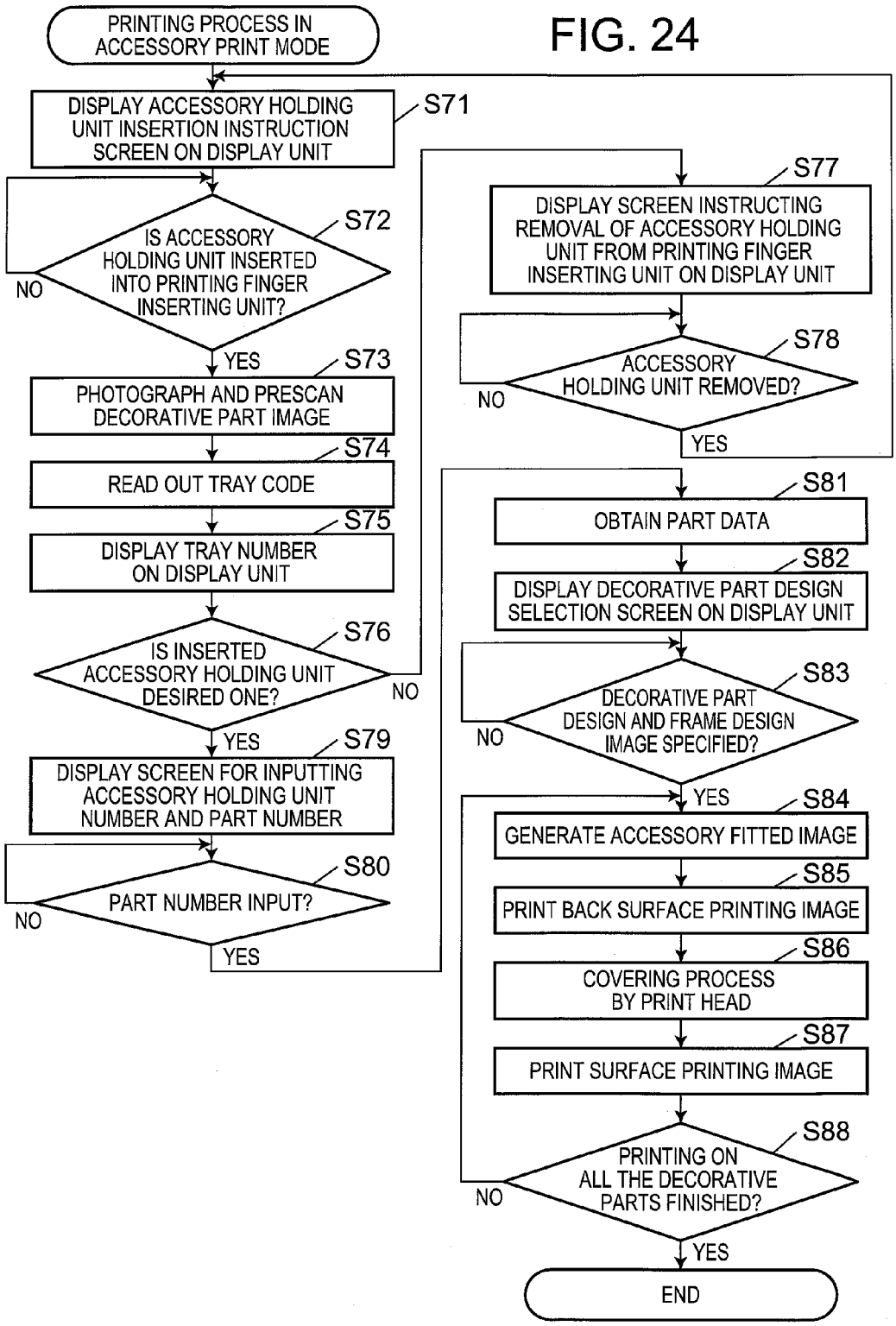
FIG. 24 is a flowchart showing printing process in an accessory print mode of the third embodiment.

FIG. 24 is a flowchart showing process in the accessory print mode in the third embodiment.

FIG. 25 is an explanation view explaining a printing procedure for the decorative part Sp in the third embodiment.

First, in the accessory print mode in the embodiment, the display control unit 521 makes the display unit 13 display an accessory holding unit insertion instruction screen instructing insertion of the printing target placement area 631 on which the decorative part Sp is placed so that the accessory positioning pin 633 of the printing target placement area 631 is fitted to the hole unit Sk of the decorative part Sp into the printing finger inserting unit 20*a* of the nail print apparatus 1 (step S71).

Thereafter, since the process from step S72 to step S81 is similar to the process from step S52 to step S61 in the second embodiment, the explanation thereof is omitted.

After obtaining the part data (step S81), the control unit 52 obtains the decorative part design Ds and frame design image F from the design data storage unit 511 on the basis of the nail design Dn selected by the user. Next, the display control unit 521 makes the display unit 13 display the decorative part design selection screen for the user to select the decorative part design Ds and frame design image F (step S82).

The decorative part design selection screen is provided with decision buttons (not shown in the drawings) for the user to select and specify the decorative part design Ds and frame design image F, and the decorative part design Ds and frame design image F to be printed on the decorative part Sp are specified by the user touching any of the decorative part design Ds and frame design image F to be printed on the decorative part Sp and pushing the decision button.

The control unit 52 determines whether the decorative part design Ds and frame design image F to be printed on the decorative part Sp are specified (step S83).

Then, if it is determined that the decorative part design Ds and frame design image F are not specified (step S83; NO), the determination process of step S83 is repeated.

On the other hand, if it is determined that the decorative part design Ds and frame design image F are specified (step S83; YES), the part printing region Ak is decided on the basis of the information included in the tray code which is read out by the tray code reading unit 526.

The fitted image generation unit 524 fits the frame design image F selected by the user to the size and such like of the part printing region Ak.

Then, the fitted image generation unit 524 fits the size and such like of the decorative part design Ds to the frame printing region Fp of the fitted frame design image F.

Then, the fitted image generation unit 524 generates the accessory fitted image Kk by superimposing the decorative part design Ds on the frame printing region Fp which is fitted in size and such like (step S84).

The printing control unit 525 creates a mirror-reversed image (back surface printing image, see FIG. 25) of the accessory fitted image Kk (surface printing image) and prints the back surface printing image on the part printing surface Ps with the print head 46 (step 85).

Then, printing is performed on the part printing surface Ps so as to cover the back surface printing image printed on the part printing surface Ps with the print head 46 (step S86, covering process).

Thus, the back surface printing image can be seen from the opposite side of the part printing surface Ps though not seen from the part printing surface Ps side.

In such way, since the back surface printing image and the accessory fitted image Kk are printed on the part printing surface Ps in the embodiment, printing can be completed without turning over the decorative part Sp, which saves trouble and is convenient.

Thereafter, the printing control unit 525 controls the print head 46 to print the surface printing image (accessory fitted image Kk) on the part printing surface Ps (step S87).

Next, the control unit 52 determines whether printing is finished for all the decorative parts Sp (step S88), and if it is determined that printing is not finished for all the decorative parts Sp (step S88; NO), the process from step S84 is performed for any of the decorative parts Sp for which printing is not finished.

On the other hand, if it is determined that printing is finished for all the printing fingers U1 (step S88; YES), printing process in the accessory print mode is finished.

Then, a snap swivel or such like is attached to the decorative part Sp and a quick-release strap Str or such like is attached thereto to complete the accessory.

After the printing process in the accessory print mode, the user may apply the coating to the part printing surface Ps. Thus, the user can prevent the decorative part design Ds from getting dirty and damaged.

In the nail print apparatus 1 in the embodiment, in such way, the accessory S is created by printing a design image on a transparent plate, printing can be freely performed for a design image such as an openwork engraving, lace pattern and feather and for an accessory frame Sf including a markedly uneven metal piece, chain, ball or such like which is difficult to place, and thus, there is more flexibility in the design of accessory S and fashion can be enjoyed more.

With respect to the other points, the embodiment is similar to the first embodiment or the second embodiment, and thus the explanation thereof is omitted.

The nail print apparatus 1 in such configuration can obtain the same effect as the nail print apparatus 1 of the first embodiment.

The accessory S may be created by bonding the two decorative parts Sp in each of which only the back surface printing image is printed on the part printing surface Ps so as to face each other's back surface. Thus, the printed surfaces are not exposed, which resists friction and damage and prevents the difference of gloss between both surfaces of accessory S.

Fourth Embodiment

Next, with reference to FIGS. 26A, 26B and 27, a fourth embodiment of the nail print apparatus according to the present invention will be described.

Since only the configuration of accessory holding unit is different from the first embodiment and such like, the differences from the first embodiment and others will be especially described hereinafter.

Figure 26B:
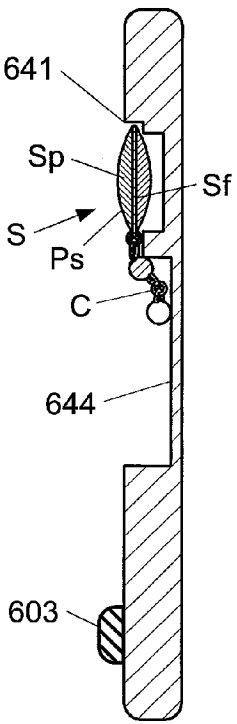
FIG. 26B is a sectional view of the accessory holding unit of FIG. 26A along the line D-D.
Figure 26A:
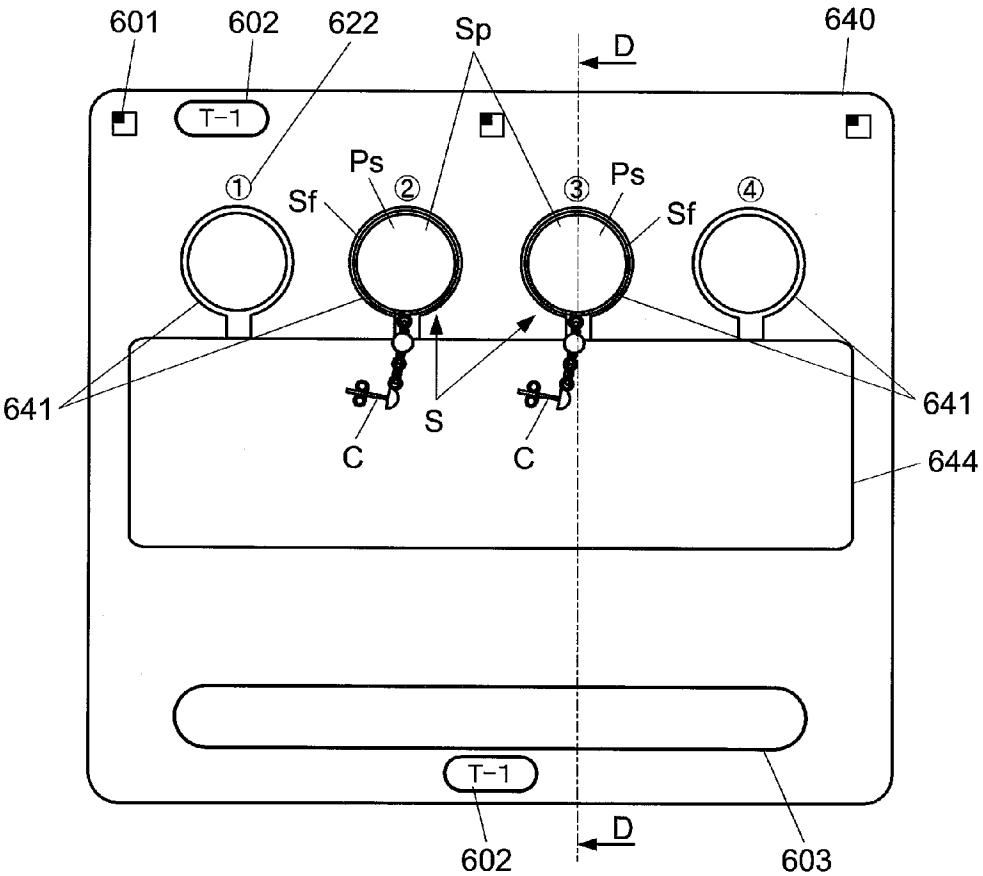
FIG. 26A is a plan view of an accessory holding unit in a fourth embodiment.

FIG. 26A is a plan view of an accessory holding unit 640 in the fourth embodiment.

FIG. 26B is a sectional view of the accessory holding unit 640 in FIG. 26A along the line D-D.

As shown in FIG. 26A, for example, the printing target placement area 641 in the fourth embodiment is different from the printing target placement areas 641 from the first embodiment to the third embodiment in that a decorative part Sp (accessory S) which is attached to an accessory frame Sf including a metal frame and decoration, rhinestone, pearl and such like can be placed.

Different from the printing target placement areas 641 from the first embodiment to the third embodiment, the printing target placement area 641 further includes a clasp containing area 644 to contain an attachment C of the accessory S when the decorative part Sp is placed on the printing target placement area 641.

The printing target placement area 641 of the fourth embodiment is formed so as to correspond to the shape of each of the accessory frames Sf.

The printing target placement area 641 is formed in such depth that the bottom surface of the printing target placement area 641 and the decorative part Sp do not contact each other when the decorative part Sp attached to the accessory frame Sf is placed thereon.

Thus, the decorative part Sp which is attached to the accessory frame Sf can be placed on the printing target placement area 641.

The shape and size of the printing target placement area 641 is not especially limited as long as the height of the surface of the decorative part Sp to be printed (part printing surface Ps) is kept to the printable height for the print head 46. For example, the printing target placement area 641 may not be in the shape (nearly circle in a plan view) corresponding to the accessory frame Sf as in the illustrated example, but may be in a square in a plan view in which the accessory frame Sf can be placed.

In a case where the decorative part Sp attached to the accessory S is placed in the printing target placement area 641, the attachment C of the accessory S is placed in the clasp containing area 644. The size, shape and such like of the clasp containing area 644 is not especially limited as long as the attachment C can be placed at a height not disturbing the printing by the print head 46 in the accessory print mode.

The location, shape, size, depth and such like of the clasp containing area 644 are not especially limited as long as the attachment C and such like of the accessory S cane be contained so as not to disturb the printing process by the print head 46.

Since the printing target placement area 641 of the embodiment includes the clasp containing area 644, even the accessory S including the attachment C and the accessory frame Sf can be placed on the printing target placement area 641 without removing the decorative part Sp and the decorative part design Ds can be printed thereon.

Since the attachment C and accessory frame Sf are contained in the clasp containing, area 644, disturbance of printing due to the contact of the attachment C and accessory frame Sf with the print head 46 during printing of the decorative part Sp can be prevented.

The clasp containing area 644 can also prevent the attachment C and accessory frame Sf from getting dirty by the ink ejected from the print head 46.

In the embodiment, as shown in FIG. 26A, the decorative part Sp is placed upside down on the printing target placement area 641, and thus the printing control unit 525 prints the accessory printing image on the decorative part Sp by making a 180-degree turn.

Since the other configurations are similar to those described in the first embodiment, the explanation thereof is omitted by assigning the same reference numerals to the same members.

Next, with reference to FIG. 27, process in the accessory print mode of the fourth embodiment will be described.

Figure 27:
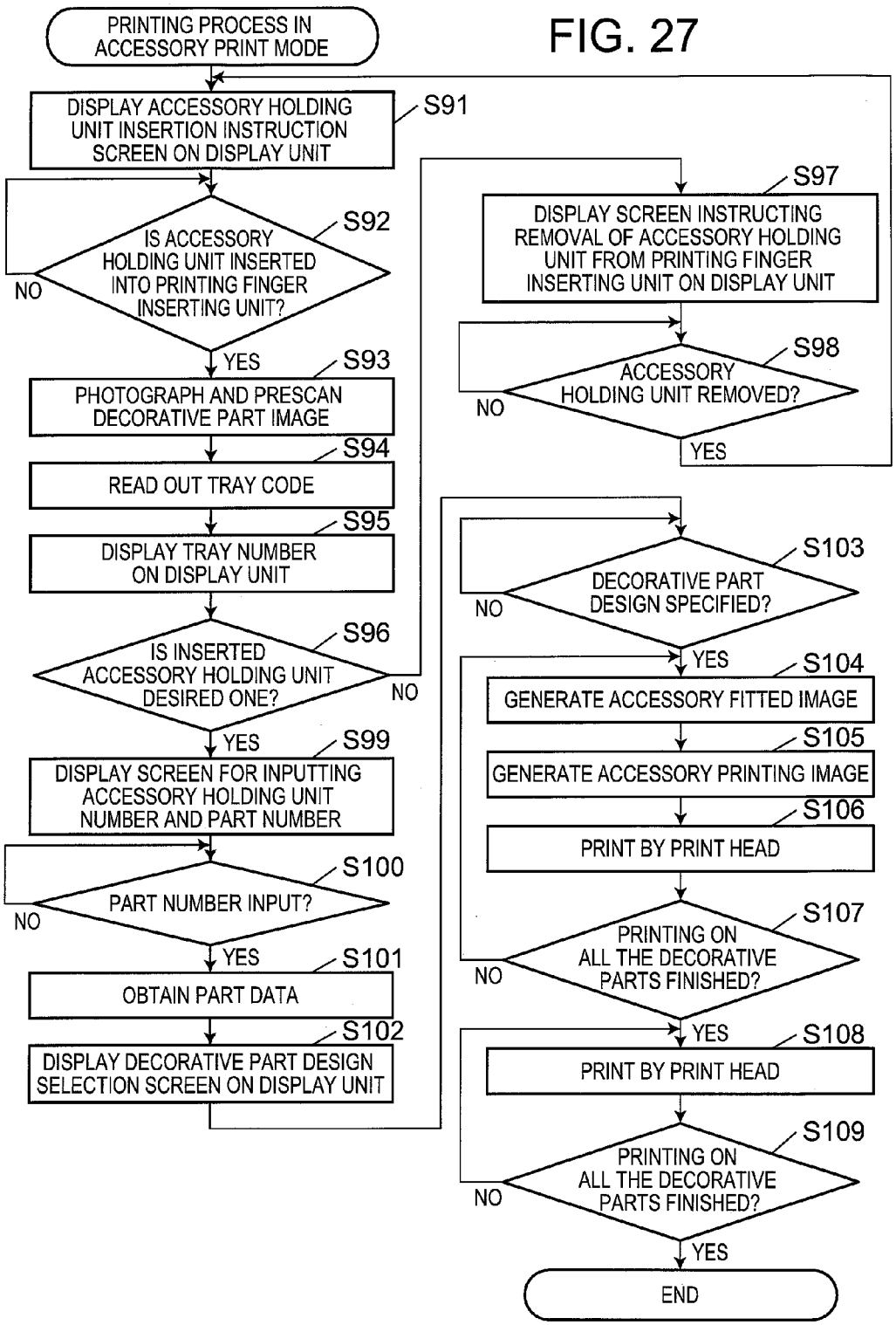
FIG. 27 is a flowchart showing printing process in the accessory print mode of the fourth embodiment.

FIG. 27 is a flowchart showing process in the accessory print mode of the fourth embodiment.

Since process from step S91 to step S104 is similar to that of step S51 to step S64 in the second embodiment, the explanation thereof is omitted.

When the process in step S104 ends, the printing control unit 525 generates the accessory printing image adjusted on the basis of the curvature of the part printing surface Ps included in the part data.

At this time, as shown in FIG. 26B, the decorative part Sp is placed upside down on the printing target placement area 641, and thus the printing control unit 525 turns the accessory printing image by 180 degrees (step S105).

Then, the printing control unit 525 controls the print head 46 to print the accessory printing image which is turned by 180 degrees on the portion to be colored of one surface of the decorative part Sp (step S106).

The control unit 52 determines whether printing is finished for all the decorative parts Sp (step S107).

If it is determined that printing is not finished for all the decorative parts Sp (step S107; NO), process from step S104 is performed for any of the decorative parts Sp for which printing is not finished.

If it is determined that printing is finished for all the decorative parts Sp, that is, if printing of one surface is finished for all the decorative parts Sp (step S107; YES), the accessories S are removed and the coating is applied to the printed decorative parts Sp.

After the coating gets dry, the decorative parts Sp are placed on the printing target placement area 641 with the unprinted surface up, and the accessory holding unit 640 is inserted into the printing finger inserting unit 20*a*.

Then, the printing control unit 525 controls the print head 46 so as to print the accessory printing image which is turned by 180 degrees on the other surface of the decorative part Sp (step S108).

The control unit 52 determines whether printing is finished for all the decorative parts Sp (step S109).

If it is determined that printing is not finished for all the decorative parts Sp (step S109; NO), the control unit 52 performs process from step S108 on any of the decorative parts Sp for which printing is not performed.

If it is determined that printing is performed for all the decorative parts Sp (step S109; YES), that is, if printing on the other surface is finished for all the decorative parts Sp, the accessories S are removed and the coating is applied to the printed decorative parts Sp. When the coating gets dry, the accessories are completed.

Applying the coating to the printed decorative parts Sp is not an essential configuration element of the present invention, and the coating may not be applied.

Also, though the accessory printing image is turned by 180 degrees to be printed on each of the decorative parts Sp in the embodiment, the present invention is not limited to this, and changes can be made appropriately according to the direction of the decorative part Sp placed on the printing target placement area 641.

Since the other points are similar to those of the first embodiment, the explanation thereof is omitted.

The nail print apparatus 1 in such configuration can also obtain the same effect as the nail print apparatus 1 of the first embodiment.

Though the embodiment of the present invention has been described, the present invention is not limited to this and various changes can be made within the scope of the present invention.

Figure 28A:
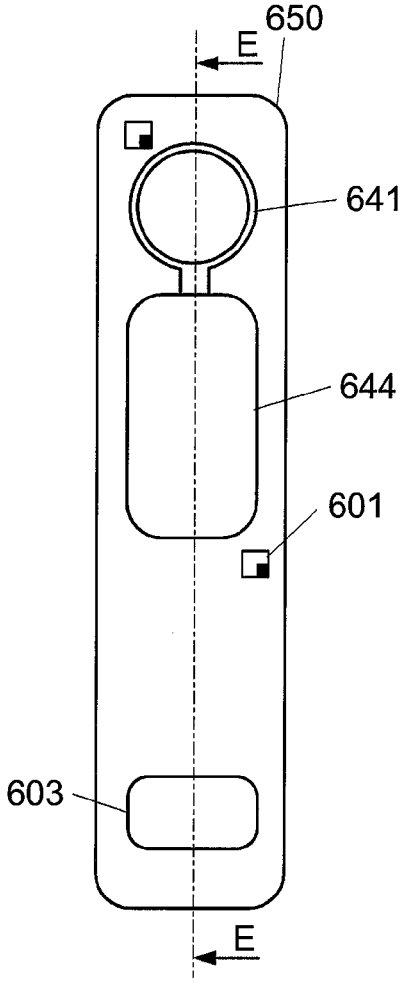
FIG. 28A is a plan view of an accessory holding unit in a first modification example of accessory holding unit of the present invention.
Figure 28B:
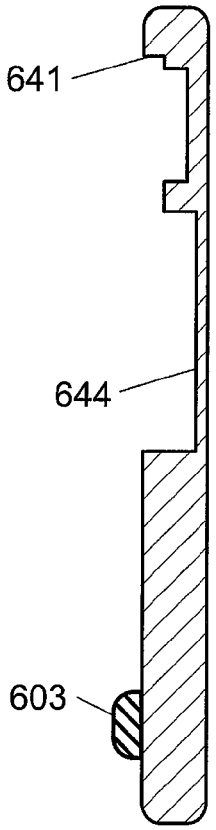
Figure 30:
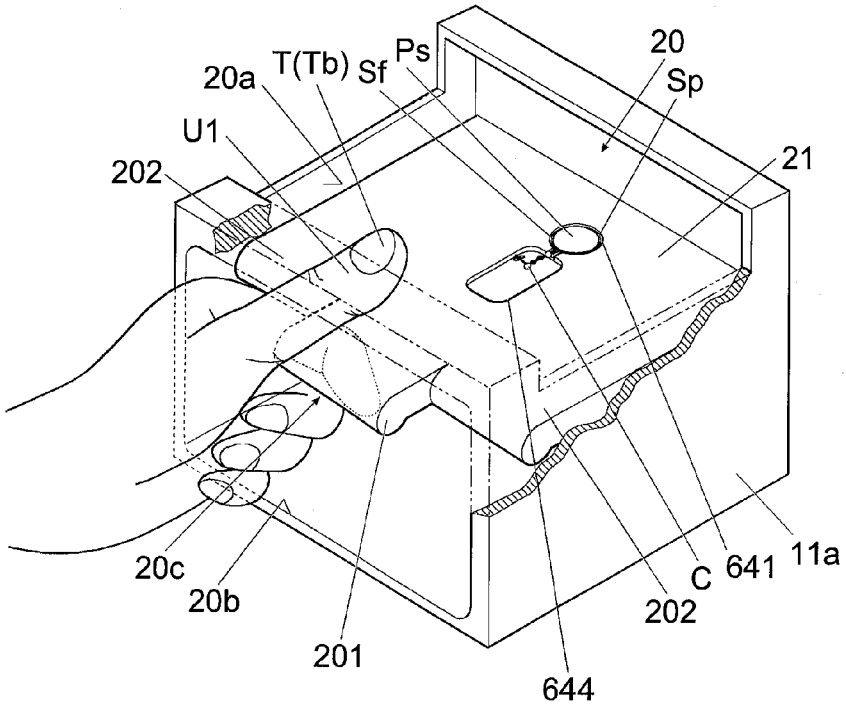
FIG. 30 is a schematic view for explaining a second modification example of accessory holding unit of the present invention.

For example, variation as shown in FIGS. 28A, 28B and 30 is possible.

FIG. 28A is a plan view of an accessory holding unit in a modification example of the accessory holding unit of the present invention.

FIG. 28B is a sectional view of the accessory holding unit in FIG. 28A along the line E-E.

Figure 29:
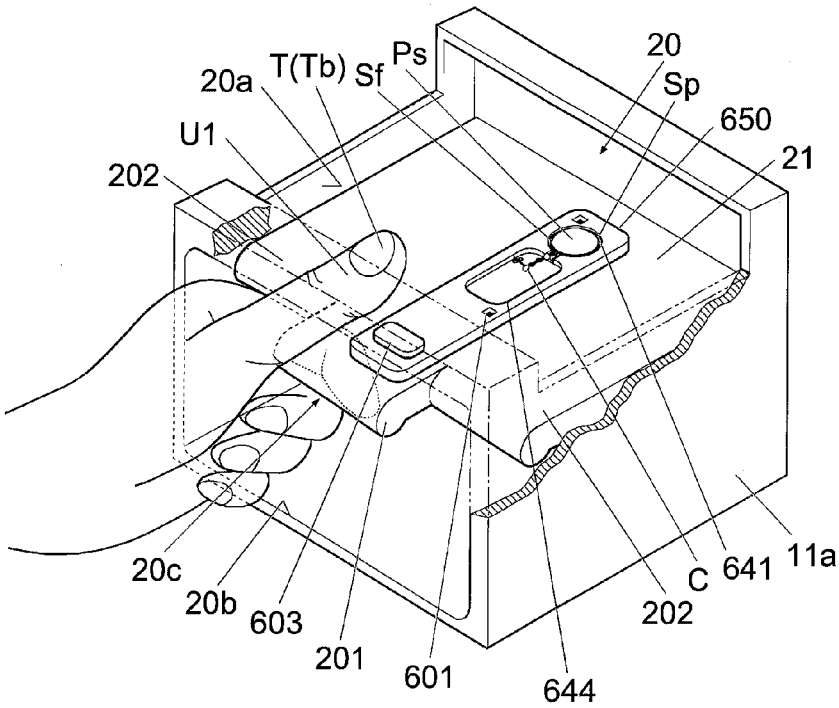
FIG. 29 is a schematic view showing a printing finger fixing unit in a case where the accessory holding unit shown in FIG. 28A and a finger are placed on the finger placement unit and printed continuously.

FIG. 29 is a schematic view of a printing finger fixing unit 20 showing an example of a case where the accessory holding unit 650 shown in FIG. 28A and a finger are placed on the finger placement unit 20*c* and printing is performed thereon continuously.

FIG. 30 is a schematic view for explaining a second modification example of an accessory holding unit of the present invention.

As shown in FIGS. 28A and 28B, the accessory holding unit 650 may be an accessory holding unit 650 on which only one accessory S can be placed. The accessory holding unit 650 includes a printing target placement area 641 and a clasp containing area 644.

In such case, a preferable configuration is such that the photographing control unit 522 makes the photographing unit 30 recognize the tray code 601 of each of the accessory holding units 650 so as to identify each of the accessory holding units 650.

By such configuration, printing can be performed continuously on a plurality of patterns of accessories S (decorative parts Sp) by placing a plurality of the accessory holding units 650 on the printing finger inserting unit 20*a*.

The modification example is possible in any of the embodiments and not limited to the accessory holding unit 650 in the fourth embodiment as in the illustrated example.

Such accessory holding unit 650 is convenient since printing can be performed on the decorative part Sp even in a compact nail print apparatus 1 which can perform printing on a finger only one by one.

Furthermore, space can be provided in the width direction X shown in FIG. 4A even when approximately one or two of such accessory holding unit 650 on which only one accessory S can be placed is placed on the finger placement unit 20*c* in the printing finger inserting unit 20*a*. Thus, the printing finger U1 can be placed in the space on the finger placement unit 20*c*. Thus, the same design image can be printed continuously on the nail T of the printing finger U1 and the decorative part Sp of the accessory S placed on the printing target placement area 641.

Though the first embodiment has been described by taking a case of coloring (surface treatment) the part printing surface Ps by ink or such like as an example, the present invention is not limited to this and the surface treatment may not be performed.

In such case, for example, it is preferable that the decorative part Sp is formed of white plastic or the like having such color that the print region extracting unit 523 can extract the part printing region Ak and the color of the decorative part design to be printed is not influenced.

Though the printable height for the print head 46 is nearly the same height of the nail T when the printing finger U1 is placed on the finger placement unit 20*c* in the above-described embodiments, the printable height for the print head 46 is not limited to this.

For example, the configuration may be such that the height of the printing surface which is printable for the print head 46 can be adjusted by the print head 46 adjusting the height thereof or adjusting the flying distance of the ink ejected from the print head 46.

In such case, since the part printing surface Ps does not need to be fitted to the height of the nail T, as shown in FIG. 30, the finger placement unit 20*c* may be used substantially as the accessory holding unit 650 by forming a same configuration as the printing target placement area 641 and clasp containing area 644 of the accessory holding unit 650 on the placement surface of the finger placement unit 20*c*, for example. Thus, the nail T and the decorative parts Sp can be placed on the printing finger inserting unit 20*a* at a time, which saves trouble and is convenient. In this case, the accessory holding unit 610 does not need to be prepared separately and the apparatus configuration can be simplified.

In addition, in the first embodiment shown in FIG. 6, for example, the depth of the concave portion of the printing target placement area 611 which is in the rectangle may be altered at two levels, three levels or such like according to the place so that the printable height for the print head 46 is nearly the same height of the nail T when the printing finger U1 is placed on the finger placement unit 20*c*. By altering the depth of the concave portion according to the place in such way, each of the decorative parts Sp is placed on the concave portion at the position of the most appropriate depth according to the height of the decorative part Sp, and thereby the heights of the upper surfaces of the decorative parts Sp can be nearly the same.

Furthermore, the configuration may be such that the depth of the concave portion of the printing target placement area 611 is previously set to be deeper and a predetermined number of underlays are layered on the concave portion of the printing target placement area 611 according to the height of the upper surface of the decorative part Sp to be adjusted at the most appropriate height.

Though the number of the decorative parts Sp which can be placed on the printing target placement area 611 and such like is not especially limited in the above embodiments, it is preferable that a plurality of the decorative parts Sp can be placed as shown in FIG. 6A, for example. In such case, since printing can be performed on a plurality of decorative parts Sp at a time, printing can be performed at a time on the four decorative parts Sp of a pair of accessories S including two decorative parts Sp on each of the front and back surfaces, for example, which is convenient.

Though the embodiments have been described by taking a case where the non-slip unit 603 formed on the upper surface of the accessory holding unit 610 shown in FIG. 6A is rubber or such like attached so as to protrude from the upper surface of the accessory holding unit 610 as an example, the present invention is not limited to this.

For example, a non-slip sheet or such like may be attached to the upper surface of the accessory holding unit 610.

Also, the non-slip unit 603 may be formed by performing a process such as embossing to uneven the upper surface of the accessory holding unit 610.

Foundation ink such as white ink may be previously applied to the nail T in the embodiments. This can improve the color of colored ink which is printed on the nail T.

Though the ink sprayed from the print head 46 is not especially limited in the above embodiments, ink which can be rubbed off by remover or such like is preferable. Since the decorative part design Ds printed on the decorative part Sp can be rubbed off in such way, the decorative part Sp can be reused, the accessory S can be made with low cost, and a pro-environmental accessory S can be made.

In this case, it is preferable that the coating is applied to the nail T before printing since the nail T can be protected from the remover.

Though the above embodiments have been described by taking the accessory holding unit 610 placed in the printing finger inserting unit 20*a* so as to be inserted and removed as an example as shown in the first embodiment, for example, the present invention is not limited to this as long as the accessory holding unit 610 holds the decorative part Sp at the printable height for the print head 46.

For example, the accessory holding unit 610 may be configured so as to be slidably inserted into and retracted from the printing finger inserting unit 20*a*.

In such case, in the nail print mode, printing is performed on the nail T in a state where the accessory holding unit 610 is retracted from the printing finger inserting unit 20*a*, and in the accessory print mode, the accessory holding unit 610 in which the decorative part Sp is placed on the printing target placement area 611 is inserted into the printing finger inserting unit 20*a* and printing process is performed in such state.

The accessory holding unit 610 may be set at a position such as around the printing finger U1 inserted into the printing finger inserting unit 20*a* and in the back side of the printing finger inserting unit 20*a* so that printing on the nail T is not disturbed. In such case, printing can be performed on the nail T of the printing finger U1 while the accessory holding unit 610 and the decorative part Sp are located in the printing finger inserting unit 20*a*.

Though the nail design Dn and the decorative part design Ds are a design having a motif such as a flower pattern in the embodiments as an example, the present invention is not limited to this, and the nail design Dn and the decorative part design Ds may be an overall pattern such as a marble pattern and a leopard pattern, for example.

Though several embodiments have been described above, the scope of the invention is not limited to the above embodiments, and includes the scope of inventions, which is described in the scope of claims, and the scope equivalent thereof.

What is claimed is:

1. A nail print apparatus, comprising:

a finger inserting unit in which a finger including a nail to be printed is inserted;

an accessory holding unit which is located in the finger inserting unit and on which at least one decorative part of an accessory is placed; and a print head which performs printing on the nail of the finger that is inserted into the finger inserting unit and on a printing surface to be printed of the decorative part that is located in the finger inserting unit and placed on the accessory holding unit, wherein:

the accessory holding unit includes a concave portion to contain the decorative part, the finger inserting unit includes a placement surface on which the finger is placed, the accessory holding unit is provided so as to be insertable into and removable from the finger inserting unit, the accessory holding unit being placeable on the placement surface when it is inserted into the finger inserting unit and being detachable from the placement surface when it is removed from the finger inserting unit, a groove or a convex portion extending in a direction in which the accessory holding unit is slidably insertable into the finger inserting unit is formed on a side wall of the finger inserting unit, and a convex portion to be fitted in the groove or a groove to fit in the convex portion is formed on a surface of the accessory holding unit facing the side wall of the finger inserting unit.

2. The nail print apparatus according to claim 1, wherein a plurality of the decorative parts are placed on the accessory holding unit, and wherein the print head continuously performs printing on the printing surfaces of the plurality of the decorative parts which are placed on the accessory holding unit.

3. The nail print apparatus according to claim 1, wherein the finger and the accessory holding unit are set in the finger inserting unit at a same time, and wherein the print head continuously performs printing on the nail of the finger and on the printing surface of the decorative part placed on the accessory holding unit which are set in the finger inserting unit at the same time.

4. The nail print apparatus according to claim 1, wherein the accessory to which the decorative part is attached is placed on the accessory holding unit with the printing surface of the decorative part facing the print head, wherein the accessory further includes an attachment, and wherein the concave portion contains the attachment.

5. The nail print apparatus according to claim 1, further comprising:

a storage unit which stores part data including a curvature value of a curved surface that is the printing surface of the decorative part; and a printing control unit which controls an amount of ink to be applied to the printing surface of the decorative part according to the curvature value in the part data that is stored in the storage unit, wherein the printing surface of the decorative part is the curved surface, and wherein the print head applies the ink to the printing surface to perform printing.

6. The nail print apparatus according to claim 5, wherein the printing control unit controls the print head so that a printing pitch when the print head performs printing is smaller as the curvature value of the curved surface which is the printing surface is larger.

7. The nail print apparatus according to claim 6, wherein a particular decorative part among a plurality of the decorative parts is placed on the accessory holding unit, the plurality of the decorative parts have different part numbers, the storage unit stores a plurality of the part data corresponding to the plurality of the decorative parts so as to be associated with a plurality of the part numbers, respectively, the printing control unit reads out particular part data corresponding to a particular part number from the storage unit according to the particular part number which is specified among the plurality of the part numbers according to the particular decorative part, and the printing control unit controls the printing pitch when applying the ink to the printing surface of the decorative part according to the curvature value in the particular part data which is read from the storage unit.

8. The nail print apparatus according to claim 7, further comprising:

a print region extracting unit which obtains a printing region corresponding to the printing surface of the decorative part; and a fitted image generation unit which generates an accessory fitted image following a shape of the printing region from an original image of a design image by fitting the design image into the printing region obtained by the print region extracting unit;

wherein the printing control unit performs printing of an image based on the design image on the nail which is inserted into the finger inserting unit, the printing control unit generates an accessory printing image for which the printing pitch is adjusted according to the curvature value in the particular part data from the accessory fitted image, and the printing control unit performs printing of the accessory printing image on the printing surface of the decorative part.

9. A nail print apparatus, comprising:

a finger inserting unit in which a finger including a nail to be printed is inserted;

an accessory holding unit which is located in the finger inserting unit and on which at least one decorative part of an accessory is placed; and a print head which performs printing on the nail of the finger that is inserted into the finger inserting unit and on a printing surface to be printed of the decorative part that is located in the finger inserting unit and placed on the accessory holding unit, wherein:

the accessory holding unit includes a concave portion to contain the decorative part, the finger inserting unit includes a placement surface on which the finger is placed, the accessory holding unit is provided so as to be insertable into and removable from the finger inserting unit, the accessory holding unit being placeable on the placement surface when it is inserted into the finger inserting unit and being detachable from the placement surface when it is removed from the finger inserting unit, a groove or a convex portion extending in a direction in which the accessory holding unit is slidably insertable into the finger inserting unit is formed on the placement surface of the finger inserting unit, and a convex portion to be fitted in the groove or a groove to fit in the convex portion is formed on a surface of the accessory holding unit contacting the placement surface.

10. A print control method of a nail print apparatus, wherein the nail print apparatus includes: a finger inserting unit in which a finger including a nail to be printed is inserted; and an accessory holding unit which is located in the finger inserting unit and on which at least one decorative part of an accessory is placed, the method comprising:

printing on the nail of the finger with a print head when the finger is inserted into the finger inserting unit, and printing on a printing surface to be printed of the decorative part with the print head when the decorative part is placed on the accessory holding unit which is located in the finger inserting unit wherein:

the accessory holding unit includes a concave portion to contain the decorative part, the finger inserting unit includes a placement surface on which the finger is placed, the accessory holding unit is provided so as to be insertable into and removable from the finger inserting unit, the accessory holding unit being placeable on the placement surface when it is inserted into the finger inserting unit and being detachable from the placement surface when it is removed from the finger inserting unit, a groove or a convex portion extending in a direction in which the accessory holding unit is slidably insertable into the finger inserting unit is formed on one of: (i) a side wall of the finger inserting unit, and (ii) on the placement surface of the finger inserting unit, and a convex portion to be fitted in the groove or a groove to fit in the convex portion is formed on one of: (i) a surface of the accessory holding unit facing the side wall of the finger inserting unit, and (ii) a surface of the accessory holding unit contacting the placement surface.

11. The print control method of the nail print apparatus according to claim 10, wherein a plurality of the decorative parts are placed on the accessory holding unit, and the printing includes continuous printing on the plurality of the decorative parts which are placed on the accessory holding unit.

12. The print control method of the nail print apparatus according to claim 10, wherein the finger and the accessory holding unit are set in the finger inserting unit at a same time, and the printing includes continuous printing on the nail of the finger and the decorative part placed on the accessory holding unit which are set in the finger inserting unit at the same time.

13. The print control method of the nail print apparatus according to claim 10, wherein the printing surface of the decorative part is a curved surface, the nail print apparatus includes a storage unit which stores part data including a curvature value of the curved surface that is the printing surface of the decorative part, and the printing includes printing by applying ink to the printing surface with the print head and controlling an amount of the ink to be applied to the printing surface of the decorative part according to the curvature value in the part data which is stored in the storage unit.

14. The print control method of the nail print apparatus according to claim 13, wherein the printing includes controlling a printing pitch when the print head performs the printing so as to be smaller as the curvature value of the curved surface which is the printing surface is larger.

15. The print control method of the nail print apparatus according to claim 14, wherein a particular decorative part among a plurality of the decorative parts is placed on the accessory holding unit, the plurality of the decorative parts having different part numbers, the storage unit stores a plurality of the part data corresponding to the plurality of the decorative parts so as to be associated with a plurality of the part numbers, respectively, and the printing includes:

reading particular part data corresponding to a particular part number from the storage unit according to the particular part number which is specified among the plurality of the part numbers according to the particular decorative part; and controlling the printing pitch when applying the ink to the printing surface of the decorative part according to the curvature value in the particular part data which is read from the storage unit.

16. The print control method of the nail print apparatus according to claim 15, wherein the printing includes:

printing an image based on a design image on the nail which is inserted into the finger inserting unit;

obtaining a printing region corresponding to the printing surface of the decorative part which is placed on the accessory holding unit;

generating an accessory fitted image which follows a shape of the printing region from an original image of the design image by fitting the design image into the obtained printing region;

generating an accessory printing image for which the printing pitch is adjusted according to the curvature value in the particular part data from the accessory fitted image; and printing the accessory printing image on the printing surface of the decorative part.

* * * * *